US007251441B2

(12) United States Patent
Hagiwara et al.

(10) Patent No.: US 7,251,441 B2
(45) Date of Patent: Jul. 31, 2007

(54) DEVELOPING APPARATUS INCLUDING MAGNETIC FIELD GENERATING MEANS, FOR USE WITH A DEVELOPER WHICH INCLUDES A MAGNETIC TONER COMPONENT

(75) Inventors: Kazunari Hagiwara, Numazu (JP); Kouichi Okuda, Tokyo (JP); Yasushi Shimizu, Shizuoka-ken (JP); Kenya Ogawa, Susono (JP); Hikaru Osada, Mishima (JP); Shuji Moriya, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 127 days.

(21) Appl. No.: 11/091,823

(22) Filed: Mar. 29, 2005

(65) Prior Publication Data

US 2005/0214031 A1 Sep. 29, 2005

(30) Foreign Application Priority Data

Mar. 29, 2004 (JP) ..... 2004-095870

(51) Int. Cl.
*G03G 15/09* (2006.01)

(52) U.S. Cl. ..... 399/267; 399/270; 399/274; 399/277

(58) Field of Classification Search ..... 399/267, 399/270, 274, 277, 282
See application file for complete search history.

(56) References Cited

U.S. PATENT DOCUMENTS

| | | | | |
|---|---|---|---|---|
| 4,292,387 | A | 9/1981 | Kanbe et al. | 430/102 |
| 4,395,476 | A | 7/1983 | Kanbe et al. | 430/102 |
| 4,913,088 | A | 4/1990 | Kanbe et al. | 118/651 |
| 5,096,798 | A | 3/1992 | Kanbe et al. | 430/120 |
| 5,122,838 | A | 6/1992 | Kohyama | 355/269 |
| 5,194,359 | A | 3/1993 | Kanbe et al. | 430/120 |
| 5,708,921 | A | 1/1998 | Yagi et al. | 399/98 |
| 6,465,144 | B1 * | 10/2002 | Hashimoto et al. | 430/106.1 |
| 2002/0028091 | A1 * | 3/2002 | Hibino | 399/267 |

FOREIGN PATENT DOCUMENTS

| | | |
|---|---|---|
| JP | 54-43027 | 4/1979 |
| JP | 55-18656 | 2/1980 |
| JP | 58-97071 | 6/1983 |
| JP | 4-15949 | 3/1992 |
| JP | 2598131 | 1/1997 |
| JP | 2001-92201 | 4/2001 |
| JP | 3225759 | 8/2001 |

* cited by examiner

*Primary Examiner*—David M. Gray
*Assistant Examiner*—Joseph S. Wong
(74) *Attorney, Agent, or Firm*—Fitzpatrick, Cella, Harper & Scinto

(57) ABSTRACT

A developing apparatus includes a developer carrying member for carrying a developer including one component magnetic toner to develop an electrostatic image formed on an image bearing member. The developer carrying member includes an elastic member contactable to the image bearing member; magnetic field generating means, for attracting the developer to the developer carrying member, and a regulating member for regulating an amount of the developer carried on the developer carrying member. The developer is regulated by the regulating member and applied on the developer carrying member at 5-16 g/mk$^2$. At a position where the regulating member is contacted to the developer carrying member, a magnetic flux density B generated by the magnetic field generating means, and a component Br of the magnetic flux density B normal to a surface of the developer carrying member, satisfy, $|Br|/|B| \leqq 0.5$.

9 Claims, 19 Drawing Sheets

DEVELOPING APPARATUS INCLUDING MAGNETIC FIELD GENERATING MEANS, FOR USE WITH A DEVELOPER WHICH INCLUDES A MAGNETIC TONER COMPONENT

FIELD OF THE INVENTION AND RELATED ART

The present invention relates to a developing apparatus for developing an electrostatic image formed on an image bearing member with a developer. More particularly, it relates to a developing apparatus of a contact type wherein a developing member is contacted to the image bearing member, with the use of a magnetic one component developer.

The image bearing member may be an electrophotographic photosensitive member, a dielectric member for electrostatic recording or the like, and the developing apparatus may be used with a cartridge detachably mountable to a main assembly of the image forming apparatus and an image forming apparatus such as a copying machine or a printer.

For example, as for a conventional one component developing system in an electrophotographic image forming apparatus wherein an electrostatic latent image formed on an electrophotographic photosensitive member is developed with one component developer, includes (1) a non-magnetic contact developing system and (2) magnetic non-contact type developing system, which are widely used.

(1) Non-magnetic Contact Developing System:

The non-magnetic one component developer is carried on a developing roller (developer carrying member) having a dielectric layer and is contacted to the surface of the photosensitive member, for developing the latent image (for example, Japanese Laid-open Patent Application No. 2001-92201). The developer accommodated in the developing device is supplied to the developing roller by a mechanical stirring mechanism or by the gravity. For example, an elastic roller is provided contacted to the developing roller, and the developer is supplied by the elastic roller. For the purpose of uniformation of a layer of the developer on the developing roller, the elastic roller also has a function of once removing the developer remaining on the developing roller without transferring to the photosensitive member. A DC bias (developing bias) is applied between the base material of the photosensitive member and the developing roller.

(2) Magnetic Non-contact Type Developing System:

In this type (for example, Japanese Laid-open Patent Application Sho 54-43027 and Japanese Laid-open Patent Application Sho 55-18656), the use is made with a magnetic one component developer, and the developer is carried on a developing sleeve (developer carrying member) which contains a magnet. The developing sleeve is opposed to the photosensitive member with a small gap between the surface of the developing sleeve and the surface of the photosensitive member. The developer jumps across the small gap to effect the development. The developer accommodated in the developing device is supplied onto the developing sleeve by a mechanical stirring mechanism or the gravity, and the developer is supplied to the developing sleeve by a magnetic force provided by the magnet. And, the developer is regulated by a developer amount regulating member into a predetermined developer layer on the developing sleeve. The force applied to the developer from the magnet is not only used for the feeding of the developer but is also used positively in the developing zone. In the developing zone, the developer is prevented from jumping to the non-image portion, so that image defect such as fog can be prevented. During the developing operation, the developer receives the magnetic force toward the magnet contained in the developing sleeve. For the jumping of the developer, a developing bias voltage which is in the form of an AC bias voltage biased with DC bias voltage is applied. The DC bias voltage has a level which is between the image portion potential and the non-image portion potential on the photosensitive member. While the developer reciprocates between the developing sleeve and the image portion and non-image portion by the AC bias voltage, the image portion is developed.

(3) Cleanerless (Toner Recycling) System:

From the standpoint of simplification of the structure and reduction of waste, a proposal has been made as to an electrophotographic process of an image transfer type wherein a drum cleaner exclusively for cleaning the photosensitive member after the image transfer step is omitted, and the toner is recycled within the apparatus. For example, in the above-described non-magnetic contact developing system, a residual developer is collected simultaneously by the developing operation (for example, Japanese Patent No. 2598131).

Also, an image forming apparatus of a magnetic non-contact type developing type has been proposed in which the residual developer is collected simultaneously by the developing operation.

The conventional non-magnetic contact developing system described above in (1) involves a problem of deterioration of fog preventing property. With repetition of the mechanical scraping by the elastic roller, the particularly property of the toner deteriorates, with the result of deterioration of the fog prevention due to the decrease of the triboelectric charge particularly property of the toner. The fog means an image defect of background contamination produced by the white portion (un-exposed portion) is slightly developed with the toner. In order to prevent the deterioration of the toner property, it would be considered to reduce the rubbing force of the elastic roller, but doing so is difficult without deterioration of prevention of ghost image defect. Here, the ghost image is density non-uniformity of a pattern of previous image in a uniform halftone image. The occurrence of ghost image means that there is toner which is not removed off the developing roller but remains thereon.

Thus, the continuous sliding rendered by the elastic roller is not preferable from the standpoint of deterioration of the toner property. The adjustment of the rubbing force involves the dilemma of fog prevention or ghost image prevention.

With the deterioration of the toner property, the developing performance is easily influenced by circulation of the developer in the developing device, as another problem. More particularly, in the circulation of the developer using a mechanical force and/or the gravity, there arises a region around the developing roller in which the developer or toner hardly circulates, and therefore, the particles hardly exchange. On the other hand, the circulating toner is deteriorated in the property to a certain extent. When the amount of the toner in the container decreases, such two kinds of toner tend to agglomerate with the result of the background fog. In addition, there is an image defect attributable to the elastic roller per se. The elastic roller is usually a sponge or foam roller from the standpoint of toner scraping and supply performance. The developer particles may be compressed into the cells of the sponge and may be agglomerated. When the agglomerated developer is off the cells, an image defect appears in a half-tone image. When this system is incorporated in a cleanerless device, paper dust may enter the cells of the elastic roller with the result of image defect which periodically appears corresponding to the length of the circumference of the elastic roller.

On the other hand, in the magnetic non-contact type developing system (2) described above, there is a problem of image defect attributable to the magnetic chain (brush). In addition, there is a problem that uniformities of thin vertical and horizontal lines are different from each other. When the developing operation is carried out while the magnetic chain moves in parallel with an advancing direction of the periphery of the photosensitive member (photosensitive drum), the uniformity of the thin line is good, but the thin line in the direction perpendicular thereto tends to break. In addition, an image edge defect arises. An edge of a high density portion, particularly a downstream side is development with high density, and an edge of half-tone portion adjacent to the high density portion is developed with a low density. The cause of this would be the reciprocation of the developer without contact between the photosensitive drum and the developing sleeve. In the developing zone, the toner moves along the surface, and therefore, the toner tends to stagnate at the downstream edge portion, and attracts the toner from an outside of the edge with the result of such an image defect. In addition, in a cleaner-less system image forming apparatus, the photosensitive drum and the developing sleeve are out of contact with each other, and therefore, the power of collecting the toner onto the photosensitive drum is weak, with the result that residual toner produces a ghost image in a solid white image (minimum density image) or in a half-tone image. In addition, white dots are produced in a solid black image (maximum density image). Such white dots tend to appear under a high temperature and high humidity condition, when paper dust enters between the developing roller and the photosensitive drum. This may be caused by a leakage of the bias voltage between the developing roller and the photosensitive drum, and as a result, a latent image potential on the photosensitive drum rises (negative side).

Furthermore, with a conventional contact-type developing device, an image defect may appear in a solid white image. The defect appears with a period corresponding to the circumferential length of the sleeve and is an image defect having a width as large as several millimeters. The cause thereof would be a tight electrostatic deposition, on the developing roller, of the developer sandwiched between the developing roller and the photosensitive drum contacted to each other.

In addition, there is a problem of toner scattering. Where the force for carrying the developer onto the developing roller reduces, the toner scatters in the image forming apparatus, which would be a cause of various troubles.

SUMMARY OF THE INVENTION

Accordingly, it is a principal object of the present invention to provide a developing apparatus with which background fog is reduced.

It is another object of the present invention to provide a developing apparatus with which a deterioration of the developer property is suppressed.

It is a further object of the present invention to provide a developing apparatus with which occurrence of the ghost image is suppressed.

It is a further object of the present invention to provide a developing device with which an image edge defect is effectively prevented.

It is a further object of the present invention to provide a developing device which is capable of forming high quality images.

It is a further object of the present invention to provide a developing device which is suitable for a so-called cleanerless type image forming apparatus which does not have a cleaner having a cleaning function only.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The description will be made as to an embodiment of a developing device according to the present invention. First, an image forming apparatus of a scheme usable with the developing device will be described.

Figure 1:
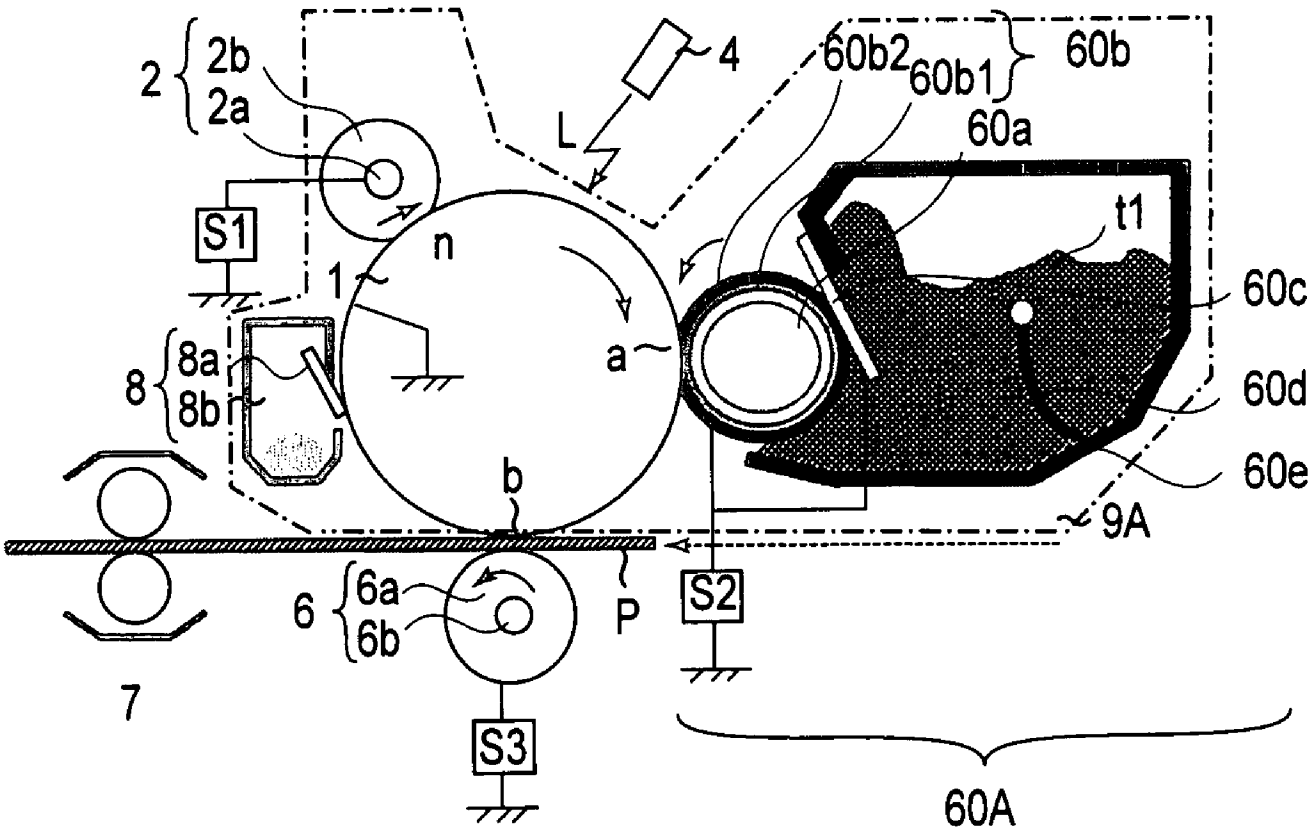
FIG. 1 is a schematic view of an image forming apparatus of scheme 1 according to Embodiment 1 of the present invention.

(Embodiment of Image Forming Apparatus of Scheme 1):

FIG. 1 is a schematic drawing of an image recording apparatus (image forming apparatus) employing one of the developing apparatuses in accordance with the present invention, showing the general structure thereof. This image forming apparatus is a laser printer of a transfer type, which employs an electrophotographic process.

(1) General Structure of Image Recording Apparatus:

Designated by a referential number 1 is an image bearing member (object to be developed). The image bearing member 1 in this embodiment is in the form of a rotatable drum (hereinafter, it will be referred to as photosensitive drum). It is a photosensitive member of an OPC type, and its inherent polarity is negative. It is 24 mm in diameter. This photosensitive drum 1 is rotationally driven in the clockwise direction indicated by an arrow mark, at a constant peripheral velocity (process speed PS; printing speed) of 85 mm/sec.

Designated by a referential number 2 is a charge roller as a charging means. This charge roller 2 is an electrically conductive elastic roller, comprising a metallic core 2*a* and an electrically conductive elastic layer 2*b*. It is kept pressed on the photosensitive drum 1 with the application of a predetermined amount of pressure, forming a charging station n between the charge roller 2 and photosensitive drum 1. In this embodiment, the charge roller 2 is rotated by the rotation of the photosensitive drum 1.

Designated by a referential character S1 is a power source for applying charge bias to the charge roller 2. In this embodiment, DC voltage, the potential level of which is higher than the charge start voltage, is applied to the contact area between the charge roller 2 and photosensitive drum 1 from the charge voltage power source S1. More specifically, a DC voltage of −1, 300 V is applied as the charge bias to the charge roller 2, which is in contact with the photosensitive drum 1, in order to uniformly charge the peripheral surface of the photosensitive drum 1 to a potential level of −700 V (potential level of unexposed point).

Designated by a referential number 4 is a laser scanner (exposing apparatus) having laser diodes, polygon mirrors, etc. This laser beam scanner is for outputting a beam L of laser light, while modulating it in intensity with sequential electrical digital image formation pixel signals, in order to scan (expose) the uniformly charged peripheral surface of the aforementioned rotational photosensitive drum 1. The laser power is adjusted such that when the whole surface of the uniformly charged photosensitive drum 1 is exposed to light, the potential of the surface of the photosensitive drum is −150V.

By the scanning exposure L and an electrostatic latent image corresponding to the intended image information is formed on the rotating photosensitive drum 1.

Designated by a referential number 60A is a developing apparatus (developing device) in the first version of the image forming apparatus which will be described later. The toner (developer) the is triboelectrically charged to a negative polarity, and is made to develop, in the development station, the electrostatic latent image on the photosensitive drum 1, by the development bias applied between the developing sleeve 60*b*, as a developer (toner) bearing member (developer bearing carrying member), and the photosensitive drum 1, by the development bias application power source S2. The developing apparatus 60A will be described later in detail when the following versions of the embodiments of the present invention, and the versions of the comparative embodiments, are described.

Designated by a referential number 6 is a transfer roller as a transferring means of a contact type, the electrical resistance of which is in the mid range. The transfer roller 6 is kept in contact with the photosensitive drum 1 with the application of a predetermined amount of pressure, forming a transfer nip b. To this transfer nip b, a recording medium P, as an object on which recording is made, is delivered with a predetermined timing from an unshown sheet feeding station, while a predetermined transfer bias is applied to the transfer roller from a transfer bias application power source S3. As a result, the toner image on the photosensitive drum is sequentially and continuously transferred onto the surface of the transfer medium P, as the transfer medium is conveyed through the transfer nip b.

The transfer roller 5 used in this embodiment comprises a core metal 5*b* and an intermediate resistance foam layer 5*a*, wherein a roller resistance value is $5\times10^{8}\Omega$. The transfer roller 5 is supplied with a voltage of +2.0 kV at the core metal 5*b* during the transfer operation. The transfer material P introduced into the transfer nip b is fed through the transfer nip b, during which the toner image is sequentially transferred from the surface of the rotatable photosensitive drum 1 onto the surface of the side by an electrostatic force and an urging force.

Designated by a referential number 7 is a fixing apparatus which employs a thermal fixing method, or the like. The transfer material P now having the toner image transferred from the photosensitive drum 1 at the transfer nip b, is separated from the surface of the rotatable photosensitive drum 1 and is then introduced into the fixing device 6, where it is subjected to fixing operation and then discharged to an outer of the apparatus as a print or copy.

Designated by a referential number 8 is a cleaning apparatus (drum cleaner) for cleaning the photosensitive drum 1. The cleaning apparatus 8 scrapes the peripheral surface of the photosensitive drum 1, with the cleaning blade 8*a*, removing thereby the residual toner, or the toner remaining on the peripheral surface of the photosensitive drum 1, from the peripheral surface of the photosensitive drum 1, after the image transfer, and recovers the toner it removed, into a waste toner container 8*b*.

After the cleaning of the peripheral surface of the photosensitive drum 1, the photosensitive drum 1 is recharged by the charging apparatus 2, and used for the next image formation.

Designated by a referential character 9A is a process cartridge, which comprises: a cartridge in which the photosensitive drum 1, charge roller 2, developing apparatus 60A, and drum cleaner 8 are integrally disposed, and which is removably mountable in the main assembly of the image forming apparatus.

Figure 2:
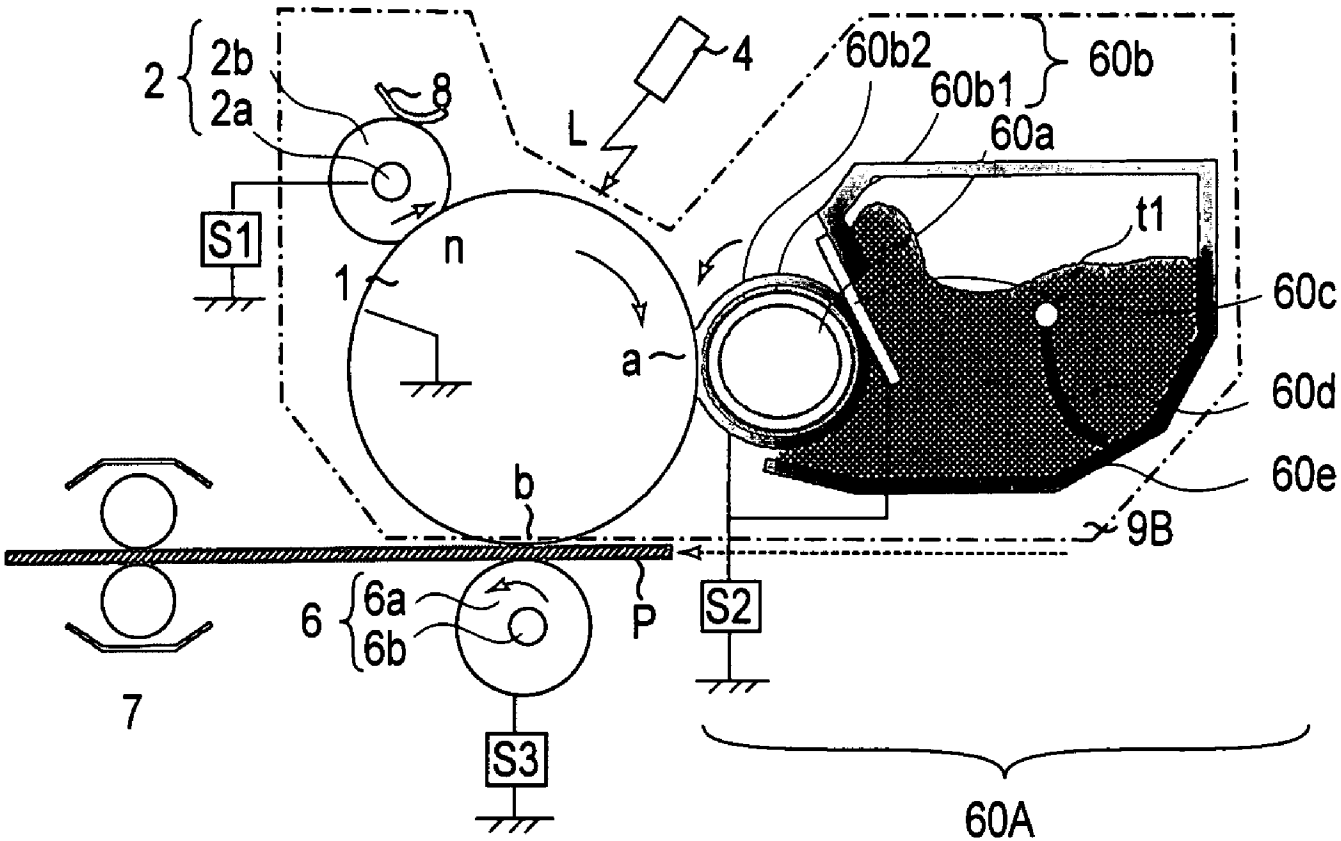
FIG. 2 is a schematic view of an image forming apparatus of scheme 2 according to Embodiment 1 of the present invention.

(Image Forming Apparatus of Scheme 2):

FIG. 2 is an image recording apparatus of scheme 2 employing the developing apparatus in the second embodiment of the present invention, showing the general structure thereof. The image recording apparatus of this scheme is a laser printer of a transfer type, which employs an electrophotographic process as well as a toner recycling process (cleaner less system). Only the features of this image forming apparatus different from those of the image forming apparatus in scheme 1 will be described; the features similar to those of the image forming apparatus in the first embodiment will not be described.

The most essential difference of the image forming apparatus of this scheme from the image forming apparatus of scheme 1 is that image forming apparatus is not equipped with the drum cleaner 8, and the transfer residual toner is recycled. In order to prevent the transfer residual toner from derogatorily affecting the other processes such as the charging process, the transfer residual toner is re circulated and is recovered into the developing apparatus. More specifically, the following structural changes are made to the image forming apparatus of scheme 2.

As for the charging of the photosensitive drum 1, a charge roller 2 identical to the charge roller 2 in scheme 1 are employed. In this embodiment, however, the charge roller 2 is independently driven. The rotational frequency of the charging roller 2 is adjusted so as to provide the same surface speeds (process speed) between the speed of the surface of the charging roller 2 and the photosensitive drum 1. With the charge roller 2 being driven independently from the photosensitive drum 1, it is assured that charge roller 2 remains in contact with the photosensitive drum 1 and a charge roller contacting member 20 to charge the toner to the negative polarity (normal polarity). Further, another reason the charge roller 2 is providing with the contacting member 20 is for preventing the charge roller 2 from remaining contaminated. With the provision of this contacting member 20, even if the charge roller 2 is contaminated with toner which is opposite (positive) in polarity to the polarity of charging bias of the charge roller 2, the contaminantive toner is changed in polarity from the positive to the negative, so that it will be swiftly ejected from the charge roller 2 to be recovered into the developing apparatus at the same time and location as a latent image on the photosensitive drum 1 is developed by the developing apparatus. The contacting member 20 is formed of a polyimide film with a thickness of 100 μm, and is placed in contact with the charge roller 2 so that linear pressure of 10 (N/m) will be maintained between the contacting member 20 and charge roller 2. The reason for the usage of polyimide is that polyimide has the property of frictionally charging toner to the negative polarity.

Designated by a referential character 9B is a process cartridge in which the photosensitive drum 1, charge roller 2, charge roller contacting member 20, and developing apparatus 60A are integrally disposed, and which is constituted so that it can be removably mounted into the main assembly of the image forming apparatus.

EMBODIMENT AND COMPARISON EXAMPLE OF DEVELOPING DEVICE

Embodiment 1 of Developing Device

This embodiment uses a contact type, an elastic sleeve, and position regulation (metal blade) between poles.

The description will be made as to a developing device 60A (FIG. 1, 2) of this embodiment.

Designated by a referential number 60*b* is a development sleeve as a developer bearing member (developer bearing carrying member), in which a magnetic roll 60*a* as a magnetic field generating means is solidly and nonrotationally disposed. The development sleeve 60*b* comprises: an aluminum cylinder 60*b*1 (base member), and a layer 60*b*2 (elastic member) of nonmagnetic and electrically conductive substance placed on the peripheral surface of the aluminum cylinder 60*b*1. It is pressed against the photosensitive drum 1 at a predetermined pressure. The pressure between the photosensitive drum 1 and the developing sleeve 60*b* is adjusted at 200 N/m (drawing pressure). Here, the drawing pressure is a pressure value corresponding to a line pressure and is a force per 1 m required to draw a SUS (stainless steel) plate of 30 μm thick sandwiched between two SUS plates each having a thickness of 30 μm.

The developing sleeve 60*b* of this embodiment is manufactured by kneading a material for the non-magnetic electroconductive elastic layer 60*b*2, extruding the kneaded material, bonding the extruded material on an aluminum sleeve 60*b*1 into a layer 60*b*2, and abrading the bonded layer 60*b*2 into a thickness of 500 μm. The developing sleeve 60*b* has a microhardness of 95°, and a surface roughness Rz of 3.8 μm and a surface roughness Ra of 0.6 μm.

In this embodiment, the surface hardness has been measured using a microhardness meter Asker MD-1F360A, available from Kobunshi Kabushiki Kaisha, Japan. The surface roughness has been measured using a surfcorder SE3400, available from KOSAKA KENKYUSHO Kabushiki Kaisha, Japan, with contact detecting unit PU-DJ2S under the condition of the measurement length of 2.5 mm, the perpendicular direction magnification of 2000 times, the horizontal direction magnification of 100 times, the cut-off level of 0.8 mm and the filter setting of 2CR, and the leveling setting of front data.

The elastic layer 60*b*2 has a dielectric constant εs of 6.5. The dielectric constant is measured by a precision LCR meter (HP4284A) available from Hewlett-Packard with the use of an electrode (HP16451B) for dielectric member measurement under the conditions of applied voltage of 1 Vpp, frequency of 1 kHz, and 10 point measurement. The dielectric constant is determined as the average.

Figure 3:
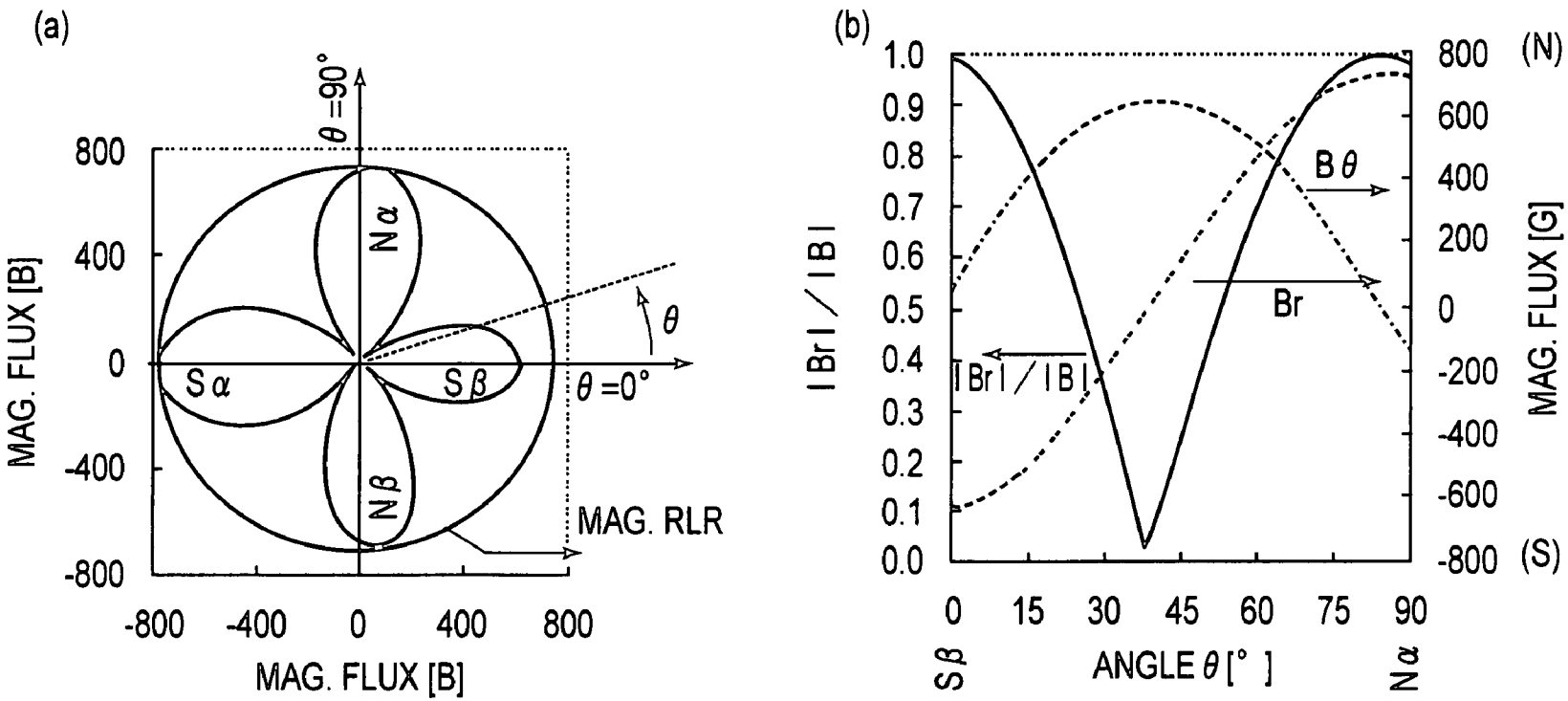
FIG. 3 is graphs of a magnetic flux density vs. $|Br|/|B|$ in a magnet roller used in Embodiment 1.

A magnet roller 60*a* is a fixed magnet functioning as magnetic field generating means for generating magnetic forces at the predetermined positions on the developing sleeve 60*b*. As shown in FIG. 3, there are peak densities at each of a developing zone (developing pole) Sα, a feeding portion (feeding pole) Nα, a supply portion (supply pole) Sβand a collecting portion (collection pole) Nβ. The magnetic flux density has been measured, in this embodiment, using Gauss meter, series 9900 with probe A-99-153, available from Bell. The Gauss meter has an axial probe in the form of a rod connected to the main assembly of the Gauss meter. The developing sleeve 60*b* is fixed in a horizontal position, and the magnet roller 60*a* is rotatable. To the developing sleeve 60*b*, the probe taking a horizontal attitude is perpendicularly disposed with a small gap, and the center of the developing sleeve 60*b* and the center of the probe are placed in the same horizontal plane. They are placed at such fixed positions, and the magnetic flux density is measured. The magnet roller 60*a* and the developing sleeve 60*b* are substantially concentric, and therefore, it is considered that clearance between the developing sleeve 60*b* and the magnet roller 60*a* are constant irrespective of the peripheral positions on the magnet roller 60*a*. In view of this, by measuring the magnetic flux density on the surface and in the normal line direction on the surface of the developing sleeve 440, while rotating the magnet roller 442*c*, the measurement covers all the positions in the circumferential direction of the developing sleeve 440. From the obtained magnetic flux density data in the peripheral directions, the peak strengths at each of the positions has been determined, and it is a normal component Br, that is, the component normal to the surface of the sleeve. Then, the normal probe is rotated by 90° to the tangent line direction of the developing sleeve 60*b*, and the magnet roller 60*a* is rotated, so that magnetic flux density in the tangent line direction is measured at the respective position of the surface of the developing sleeve, as the tangent line components BΘ.

From the values Br and BΘ at the respective angular positions, the magnetic flux density $|B|=|Br2+B\Theta2|^{1/2}$ is calculated at each of the angular positions of the surface of the developing sleeve.

Then, a ratio of the normal component of the |Br| relative to the magnetic flux density |B|, that is, |Br|/|B| is determined.

The results and Br, BΘ are shown in FIG. 3, (b). With respect to the angle of abscissa, the point of origin corresponds to the supply portion Sβpole, and the positive direction is toward downstream with respect to the rotational direction of the sleeve (Sβ-Nα-Sα-Nβ-Sβ). The right-hand side ordinate represents strength of the magnetic flux density, and N-pole is positive, and S-pole is negative, and the left-hand side ordinate represents |Br|/|B|.

The one component magnetic toner t1 (developer) is produced by mixing and kneading binder resin, magnetic particles and charge control material, and then pulverizing the mixture, and classifying the pulverized material. Fluidization material is externally added. The developer contains the same weights of the magnetic particles and the binder resin to provide magnetic particles which can be conveyed by sufficiently strong magnetic force. The average particle size (D4) of the toner is 8 μm.

In the process of being carried on the developing sleeve 60*b* under the influence of the magnetic force from the magnet roller 60*a*, the toner t1 is subjected to a layer thickness regulation of the regulating blade 60*c* (developer amount regulating member) for regulating the amount of the developer on the developing sleeve, and is also subjected to triboelectric charging. Designated by 60*d* is a stirring member for circulating the toner in the developing container 60*e* and feeding the toner sequentially into magnetic force reaching ranges around the surface of the sleeve.

In the developing device 60A of this embodiment, in order to provide a desired toner charge amount and coating amount, the regulating blade 60*c* functioning as a developer amount regulating member, is made of a phosphor bronze having a thickness of 120 μm, and the contact position (regulation position) relative to the developing sleeve 60*b* is Θ=38° (|Br|/|B|=0.03) as shown in FIG. 3, and the drawing pressure is 55 (N/m), and the free length of the blade is 2.5 mm. The length of the free part on the blade is a length from the contact portion of the regulating blade 60*c* relative to the developing sleeve 60*b*. Here, setting the contact position of the regulating blade 60*c* to the developing sleeve 60*b* at the magnetic pole region where the horizontal magnetic field is dominant (|Br|/|B|≦0.5), as in this embodiment, is called "in-between regulation" (at a position between the poles). The developing device of this embodiment is not provided with a developer feeding member for supplying the toner to the developing sleeve. Therefore, the member to which the developing sleeve first contacts after contact to the photosensitive drum is the regulating blade.

The toner t1 applied on the developing sleeve 60*b* is fed to the developing zone (developing zone portion) a where the developing sleeve 60*b* is opposed to the surface of the photosensitive drum 1, by the rotation of the developing sleeve 60*b*. The developing sleeve 60*a* is supplied with developing bias voltage (only DC voltage −450V without AC voltage component) from a developing bias applying voltage source S2.

The developing sleeve 60*b* and the regulating blade 60*c* are electrically connected to make their potential equal to each other. The developing sleeve 60*b* is driven at a peripheral speed which is 1.2 times the peripheral speed of the photosensitive drum 1. The electrostatic latent image on the photosensitive drum 1 is developed with the toner t1 through reverse development. Here, the peripheral speed of the developing sleeve 60*b* relative to the photosensitive drum 1 is 1.2 times, but this is not inevitable, and may be 1.0-2.0 times the peripheral speed of the photosensitive drum, with which the advantageous effects of this embodiment are provided.

Comparison Example 1 of Developing Device

Contact Type Elastic Sleeve, Pole Position Regulation

A developing device of this comparison example is similar to the developing device 60A of Embodiment 1, but is different in the contact condition of the regulating blade 60*c* to the elastic sleeve (developing sleeve 60*b*).

In this comparison example, the contact position of the regulating blade 60*c* is Θ=84° (|Br|/|B|=0.99) as shown in FIG. 3, and the drawing pressure is 80 (N/m), and the free length of the blade is 1.5 mm.

Here, setting the contact position of the regulating blade 60*c* to the developing sleeve 60*b* at a magnetic pole region where the perpendicular magnetic field is dominant (|Br|/|B|≧0.9), is called "pole position regulation"

Comparison Example 2 of Developing Device

Magnetic Non-contact Type Developing System, In-between Regulation

Figure 4:
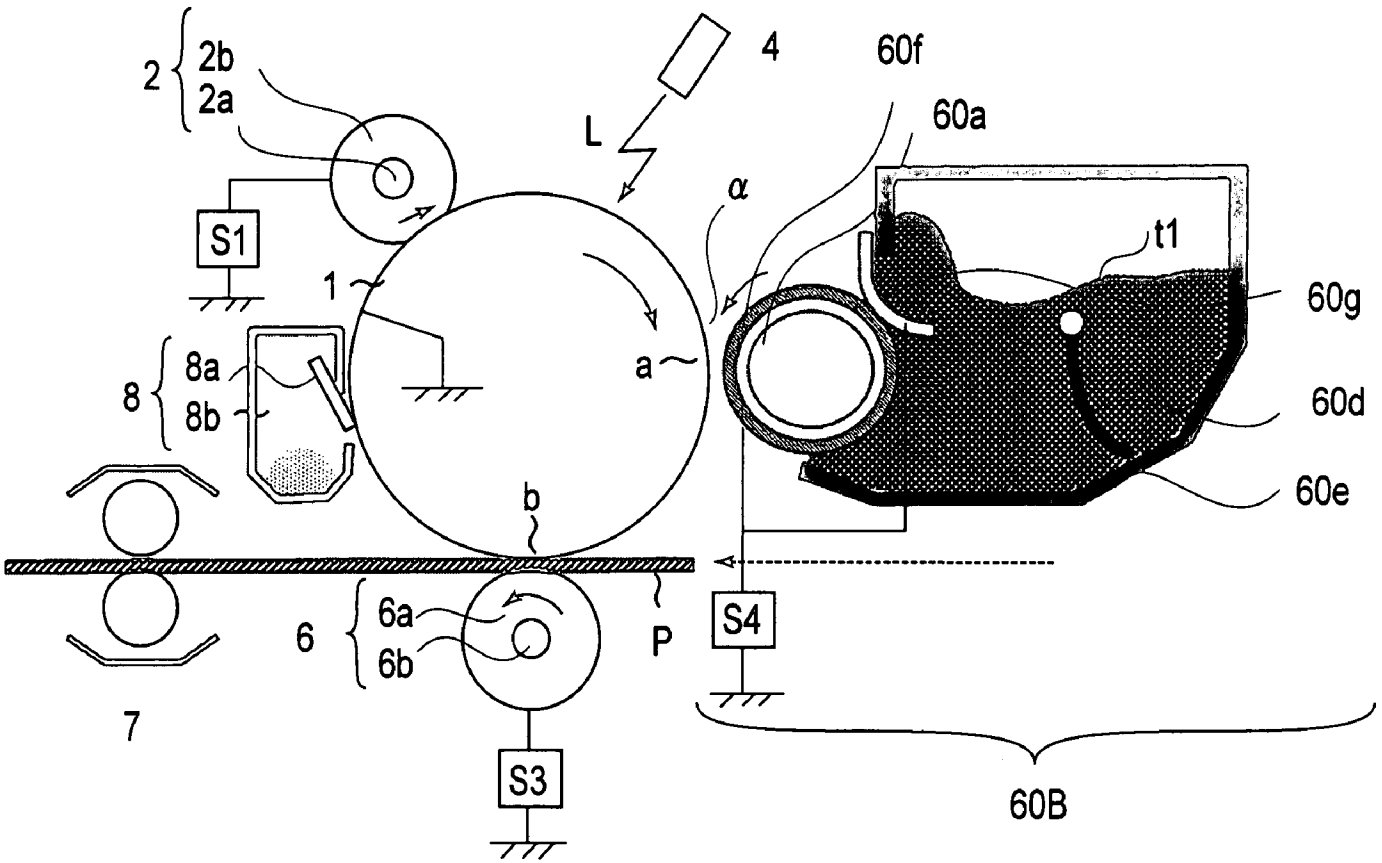
FIG. 4 is a schematic view of an image forming apparatus of scheme 1 according to a comparison example 2.
Figure 5:
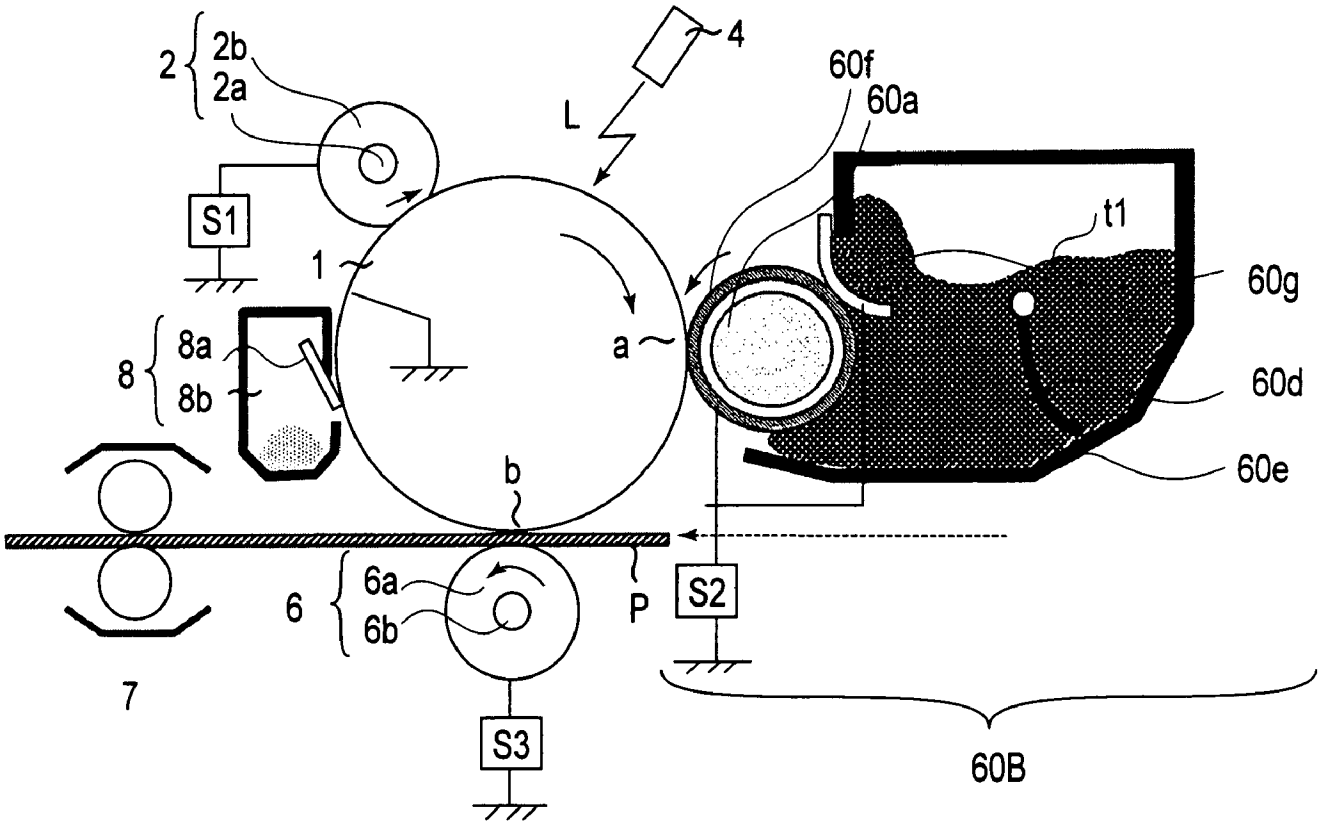
FIG. 5 is a schematic view of an image forming apparatus of scheme 1 according to a comparison example 4.

A developing device 60B of this comparison example will be described. FIG. 4 is a schematic view of an image forming apparatus of scheme 1 using the developing apparatus of this comparison example. The toner used here is toner t1 which will be described hereinafter.

Designated by 60*f* is a developing sleeve (developer carrying member) containing therein a magnet roller 60*a* which is the same as that used in Embodiment 1. The developing sleeve 60*f* is an aluminum cylinder having a surface treated by sandblasting for a desired roughness, and is disposed opposed to the photosensitive drum 1 with a gap α of 300 μm. The developing sleeve 60*f* has a microhardness of 100°, and the surface roughness Rz is 11.5 μm, and Ra is 1.5 μm. The toner t1 filled in the developing device 60B is carried by the developing sleeve 60*f* while being subjected to a magnetic force provided by a magnet roller 60*a*. And, in this process, the toner t1 is subjected to a layer thickness regulation and charging by a regulating blade 60*g* of urethane having a thickness of 1.5 mm. Designated by 60*d* is a stirring member for circulating the toner in the developing container 60*e* and feeding the toner sequentially into magnetic force reaching ranges around the surface of the sleeve.

In the developing device 60B of this example, in order to provide a desired toner charge amount and coating amount, the contact position of the regulating blade 60*g* to the developing sleeve 60*f* is Θ=38° in FIG. 3, (b) where |Br|/|B|=0.03, and the drawing pressure is 30 N/m, and the free length of the blade is 1.2 mm.

The toner t1 applied on the developing sleeve 60*f* is fed to the developing zone (developing zone portion) a where the developing sleeve 60*f* is opposed to the surface of the photosensitive drum 1, by the rotation of the developing sleeve 60*f*. The developing sleeve 60*f* is supplied with a developing bias voltage comprising DC voltage component of −450V, AC voltage component (rectangular wave) of 1.8 kVpp and 1.6 kHz. The developing sleeve 60*f* is driven at a peripheral speed which is 1.2 times the peripheral speed of the photosensitive drum 1. In this manner, the electrostatic latent image on the photosensitive drum 1 is developed with the toner t4 (reverse development). The developer is the toner t1 used in Embodiment 1.

Comparison Example 3 of Developing Device

Magnetic Non-contact Development, Pole Position Regulation

The comparison example of this example is similar to the developing device 60B of comparison example 2, but the contact condition of the regulating blade 60*g* to the elastic sleeve 60*f* is different.

In this comparison example, the contact position of the regulating blade 60*g* is Θ=84° (|Br|/|B|=0.99) as shown in FIG. 3, and the drawing pressure is 80 (N/m), and the free length of the blade is 1.5 mm.

Comparison Example 4 of Developing Device

Rigid Member Sleeve, Contact Developing System, In-between Regulation

The developing device of this comparison example is similar to the developing device 60B of comparison example 2, but is different therefrom in the following.

A developing sleeve 60*f* of aluminum cylinder not having an elastic layer is contacted to the photosensitive drum 1 with a predetermined pressure. A drawing pressure between the photosensitive drum 1 and the developing sleeve 60*g* is 50 N/m. The developing bias applied is only DC voltage of −450V.

Comparison Example 5 of Developing Device

Non-contact Elastic Sleeve, In-between Regulation

Figure 6:
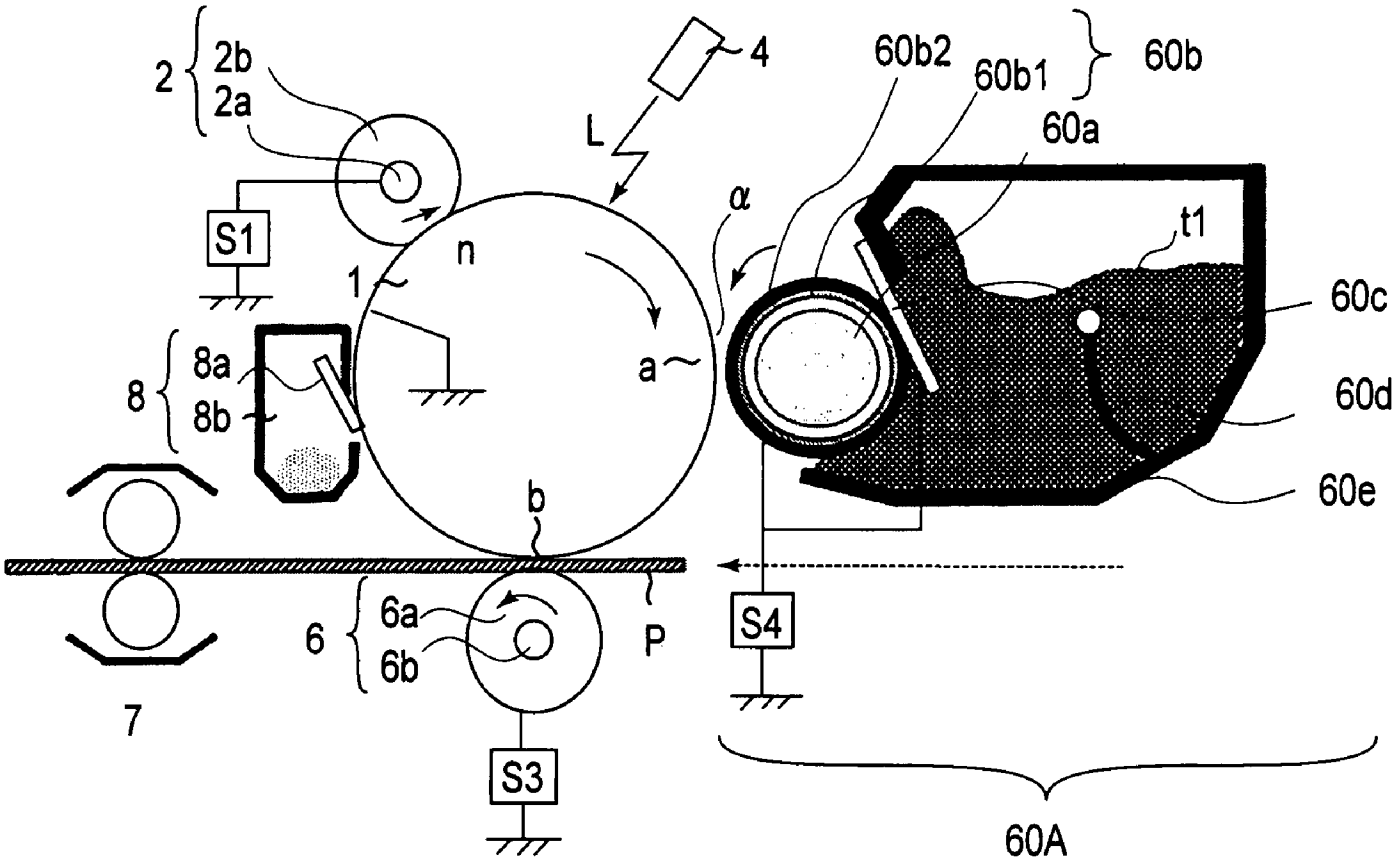
FIG. 6 is a schematic view of an image forming apparatus of scheme 1 according to a comparison example 5.

FIG. 6 is a schematic view of an image forming apparatus of scheme 1 using the developing apparatus of this comparison example.

The developing device of this comparison example is different from the developing device 60A in Embodiment 1 in the following.

The photosensitive drum 1 and the developing sleeve 60*b* are disposed opposed to each other with a gap α of 200 μm therebetween. The developing bias voltage comprises a DC voltage of −450V, an AC voltage of rectangular wave having a peak-to-peak voltage of 1.2 kVpp and a frequency of 2000 Hz.

Developing Device of Comparison Example 6

Non-contact Elastic Sleeve, Pole Position Regulation

FIG. 6 is a schematic view of an image forming apparatus of Embodiment 1 used with the developing apparatus of this comparison example.

The developing device of this comparison example is similar to the developing device 60A of comparison example 1, but is different therefrom in the following.

The photosensitive drum 1 and the developing sleeve 60*b* are opposed to each other with a gap α of 200 μm therebetween. The developing bias voltage comprises a DC voltage of −450V and an AC voltage of rectangular wave having a peak-to-peak voltage of 1.2 kVpp and a frequency of 2000 Hz.

Developing Device of Comparison Example 7

Rotary Type Multi-pole Magnet Roller

Figure 7:
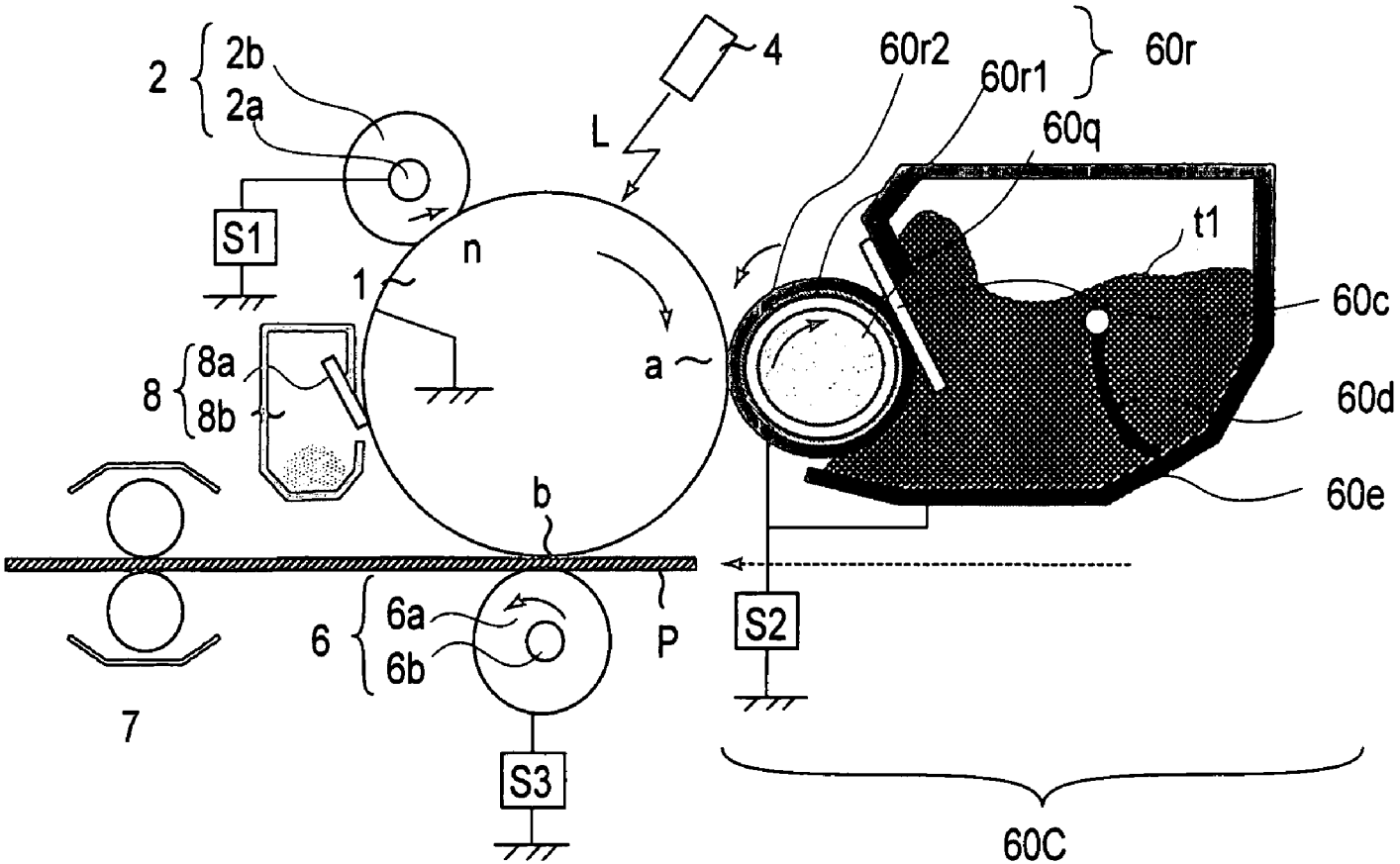
FIG. 7 is a schematic view of an image forming apparatus of scheme 1 according to a comparison example 7.

The description will be made as to a developing device 60C of this comparison example. FIG. 7 is a schematic view of an image forming apparatus of scheme 1 used with the developing apparatus of comparison example 7.

Designated by 60*r* is a developing sleeve (developer carrying member) containing a magnet roller 60*q*. The development sleeve 60*r* comprises: an aluminum cylinder 60*r*1, and a layer 60*r*2 of nonmagnetic and electrically conductive substance placed on the peripheral surface of the aluminum cylinder 60*r*1. The developing sleeve 60*r* is contacted to the photosensitive drum 1 with a predetermined pressure. The drawing pressure is 200 N/m.

The developing sleeve 60*r* is produced by kneading a non-magnetic material for the electroconductive elastic layer 60*r*2, extruding the kneaded material, bonding the extruded material on the aluminum cylinder 60*r*1, and then abrading the surface into a thickness of 500 μm of the layer 60*r*2. The developing sleeve 60*r* has a microhardness of 94°, and a surface roughness Ra of 1.2 μm.

The magnet roller 60*q* is a multi-pole magnet roller having 8 poles at regular intervals. The peak of the magnetic flux density provided is 300 G (absolute value). The magnet roller 60*q* is rotated in the direction opposite the direction of the developing sleeve 60*r* in the same rotational speeds.

The toner t1 is carried on the developing sleeve 60*q* while being subjected to the magnetic force provided by the magnet roller 60*q*, during which a layer thickness of the toner t1 is regulated by the regulating blade 60*c*, and the toner t1 is triboelectrically charged. Designated by 60*d* is a stirring member for circulating the toner in the developing container 60*e* and feeding the toner sequentially into magnetic force reaching ranges around the surface of the sleeve.

The developing device 60C of this example employs a regulating blade 60*c* which has a length of a free part of 1.2 mm and which is placed so that drawing pressure is 30 (N/m), in order to provide a desired toner charge amount and coating amount.

The toner t1 applied on the developing sleeve 60*r* is carried by the rotation of the sleeve 60*r* to a developing zone (developing zone portion) a where the developing sleeve 60*r* is opposed to the photosensitive drum 1. The sleeve 60*r* is supplied with a developing bias voltage DC voltage of −450V) from the developing bias applying voltage source S2. The developing sleeve 60 *r* is driven at a peripheral speed which is 1.2 times the peripheral speed of the photosensitive drum 1. By this, the electrostatic latent image on the photosensitive drum 1 is developed with the toner t1 through reverse development.

The toner t1 used here is the same as with Embodiment 1.

Japanese Patent Application Publication Hei 4-15949 discloses a developing device which is similar to the structure of this comparison example.

Developing Device of Comparison Example 8

Non-magnetic Contact Developing System

Figure 8:
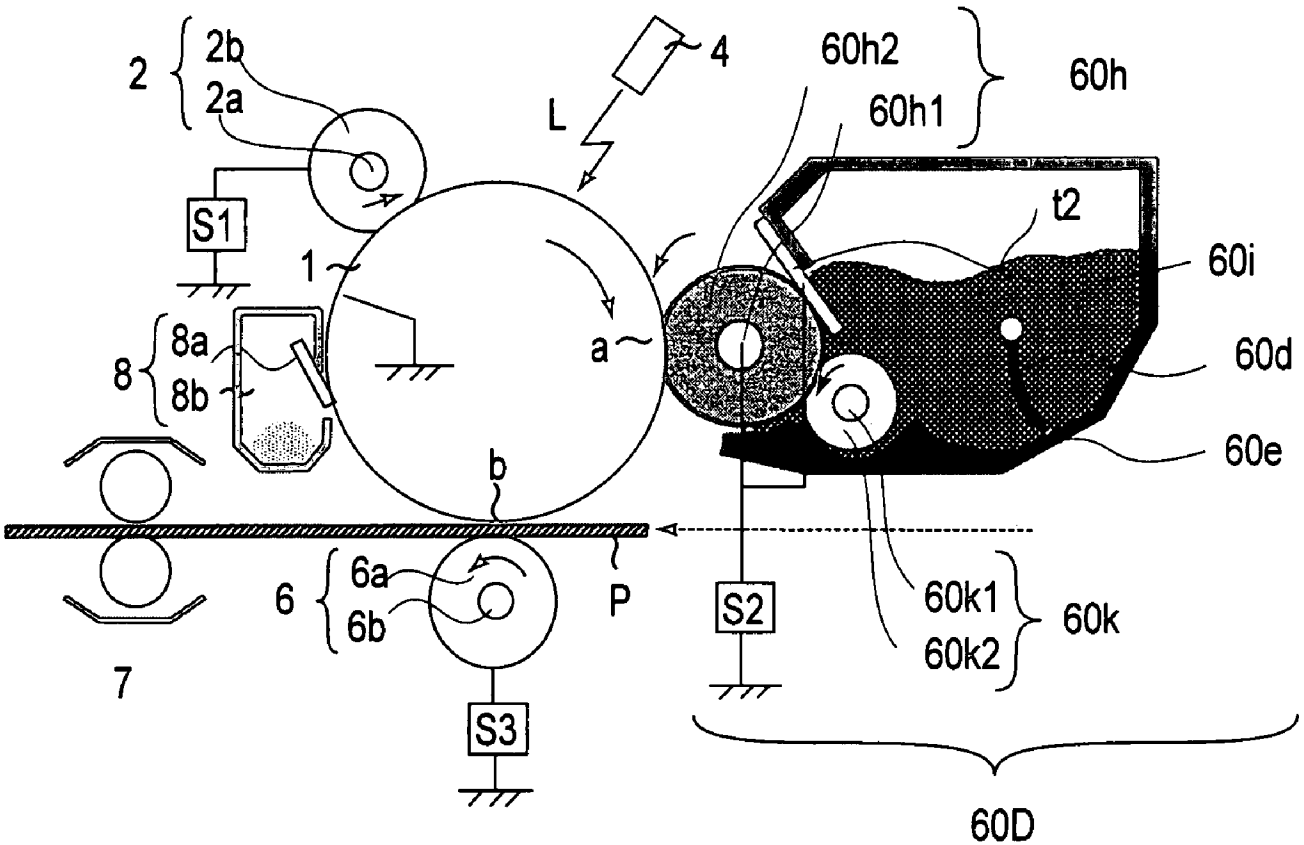
FIG. 8 is a schematic view of an image forming apparatus of scheme 1 according to a comparison example 8.

A developing device 60D of this comparison example will be described. FIG. 8 is a schematic view of an image forming apparatus of scheme 1 used with the developing apparatus of comparison example 7.

Designated by 60*h* is a developing roller comprising a core metal 60*h*1 and an electroconductive elastic layer 60*h*2 formed thereon. Designated by 60*k* is an elastic roller comprising a core metal 60*k*1 and an elastic layer 60*k*2 formed thereon. The developing roller 60*h* is contacted to the photosensitive drum 1 with a predetermined pressure corresponding to a drawing pressure of 20 N/m. The elastic roller 60*k* is fixed with a predetermined distance between the shafts of the developing roller 60*h* and the elastic roller 60*k*, and the drawing pressure therebetween is 40 N/m. The developing roller 60*h* is rotated at a peripheral speed which is 1.4 times the peripheral speed of the photosensitive drum 1, and the elastic roller 60*k* is rotated such that peripheral movement thereof is opposite that of the developing roller and at the same peripheral speed. The rubber hardness of the developing roller 60*h* is 50° in ASKER C at 500 g load, and the microhardness is 42°.

The toner t2 is supplied to the elastic roller 60*k* by a stirring member 60*d*. The elastic roller 60*k* supplies the toner t2 to the developing roller 60*h* by the rotation thereof. The toner supplied onto the developing roller 60*h* is triboelectrically charged and is regulated into a predetermined thickness by the regulating blade 60*i*. The toner fed to the developing roller 60*h* is used for developing the latent image on the photosensitive drum at the developing zone a. The toner not consumed for the development and remaining on the developing roller 60*h* is scraped off by the elastic roller 60*k*, and is recirculated in the container 60*e* and is again applied on the surface of the developing roller 60*h*.

The developing bias voltage applied to the core metal 60*h*1 of the developing roller comprises only a DC component (DC voltage of −450V). The elastic roller 60*k* and the regulating blade 60*i* are also supplied with the same developing bias.

The used toner t2 is one component magnetic toner t2 and is produced by mixing and kneading binder resin, coloring material, magnetic particle and charge control material and by a pulverization and classification. It contains externally added material for fluidization and charging particles m. The average particle size (D4) of the toner is 8 μm.

Developing Device of Comparison Example 9

Non-contact Feeding Roller

Figure 9:
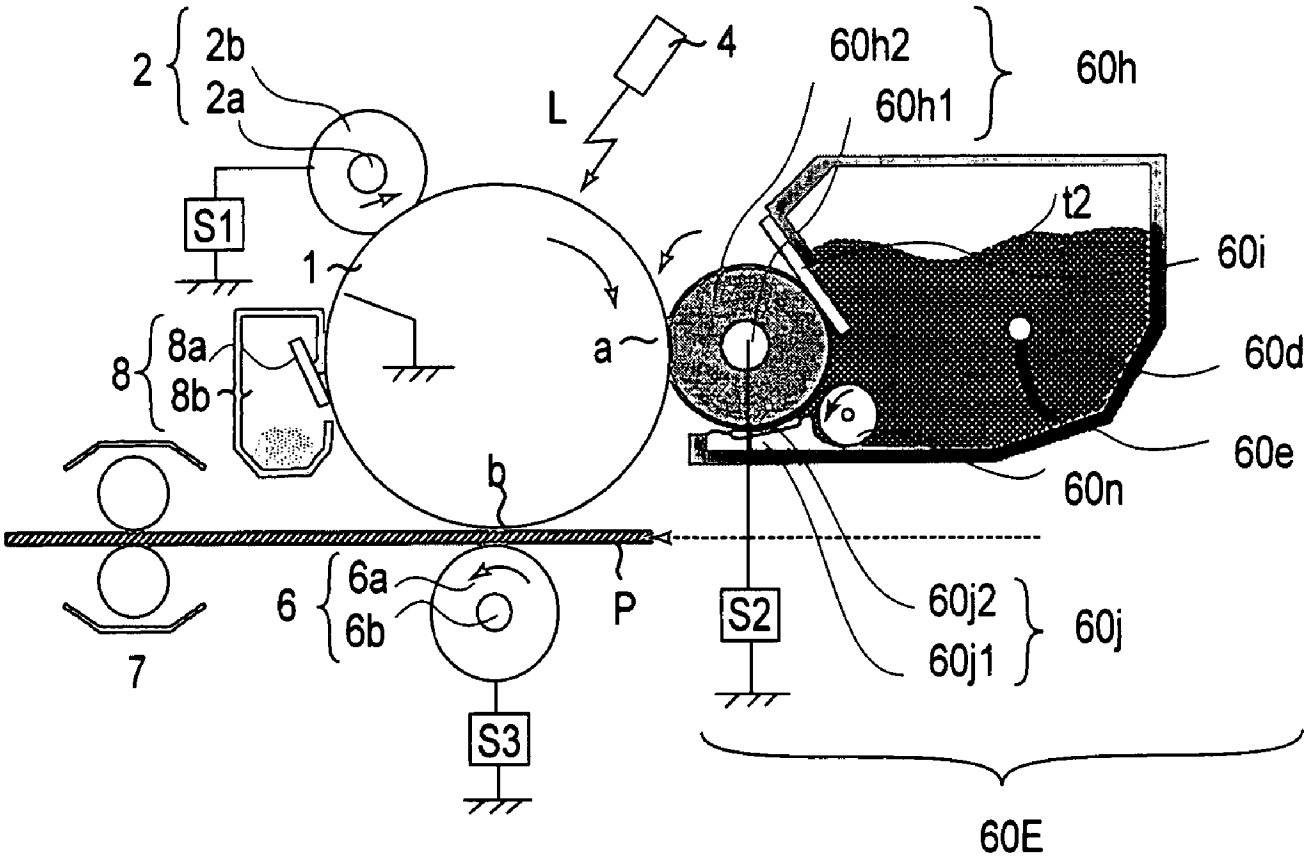
FIG. 9 is a schematic view of an image forming apparatus of scheme 1 according to a comparison example 9.

A developing device 60E of this comparison example will be described. FIG. 9 is a schematic view of an image forming apparatus of scheme 1 used with the developing apparatus of comparison example 9.

Designated by 60*h* is a developing roller comprising a core metal 60*h*1 and an electroconductive elastic layer 60*h*2 formed thereon. Designated by 60*j* is a discharging sheet including an electroconductive sheet 60*j*2 which is lined with an elastic member 60*j*1. The developing roller 60*h* is contacted to the photosensitive drum 1 with a predetermined pressure corresponding to a drawing pressure of 20 N/m. The discharging sheet 60*j* is urged to the developing roller 60*h* with a predetermined pressure so that drawing pressure is 55 N/m. The developing roller 60*h* is rotated at a peripheral speed which is 1.4 times the peripheral speed of the photosensitive drum 1. There is provided a toner feeding roller 60*n* which is not contacted to the developing roller 60*h*, which is rotated at the same peripheral speed as the developing roller. The rubber hardness of the developing roller 60*h* is 50° in ASKER C at 500 g load, and the microhardness is 42°.

The toner t2 is supplied to the feeding roller 60*n* by the stirring member 60*d*. The feeding roller 60*n* disposed not contacted to the developing roller 60*h* is effective to supply the toner t2 onto the developing roller 60*h* by the rotation thereof. The toner supplied onto the developing roller 60*h* is triboelectrically charged and is regulated into a predetermined thickness by the regulating blade 60*i*. The toner fed to the developing roller 60*h* is used for developing the latent image on the photosensitive drum at the developing zone a. The toner not consumed by the development and remaining on the developing roller 60*h* is electrically discharged by the discharging sheet 60*j*, and then is recirculated in the container 60*e* and is again applied on the developing roller 60*h*.

The developing bias applied to the core metal 60*h*1 of the developing roller is a DC voltage of −450V. The feeding roller 60*n* and the regulating blade 60*i* are supplied with the same developing bias potential.

Toner t2 is the same as with comparison example 8.

Japanese Patent No. 3225759 discloses a developing device which is similar to the structure of this comparison example.

(Measurements of Specific Charge of Toner and Amount of Coating Toner)

Figure 10:
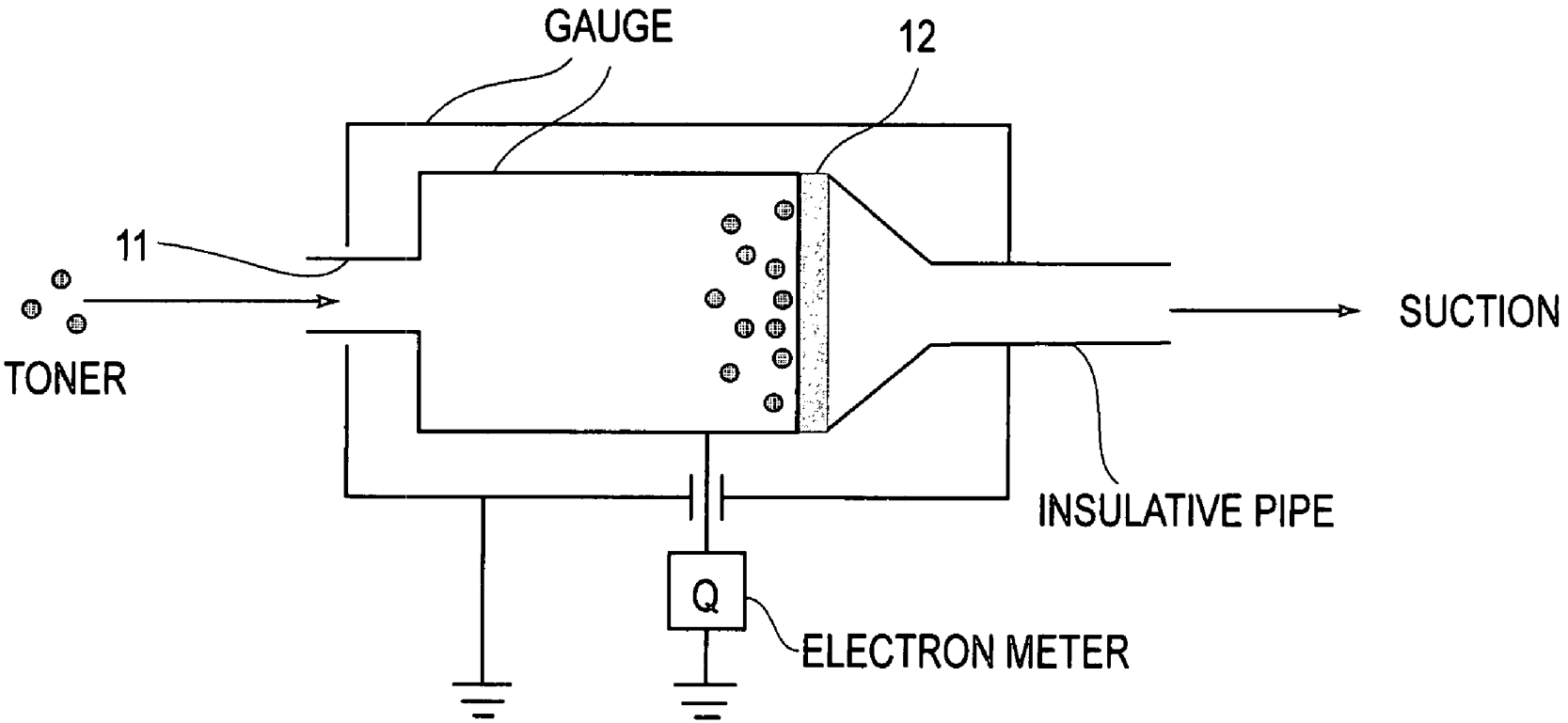
FIG. 10 shows a measuring device using a suction type Faraday gauge method.

The specific charge of the toner and the coating amount of the toner are measured in the following manner. The amount of electric charge of the developer coating the developing roller or the developing sleeve is measured by so-called suction type Faraday gauge method. FIG. 10 shows an apparatus used in the measurement through the suction type Faraday gauge method, wherein the suction opening 11 is abutted to the developing sleeve or developing roller, and the developer is sucked to collect the toner on a filter 12 provided in an inner cylinder. At this time, the inner cylinder is electrostatically shielded from outside, and the amount Q (C) of electric charge of the developer accumulated here is measured by an electrometer 6517A, available from KEITHLEY Corp. The weight M (g) of the sucked developer is calculated on the basis of the increase of the weight of the filter, and the area S (m2) from which the toner is sucked is measured, too. Then, the specific charge of the developer on the sleeve Q/M (μC/g) and the amount of coating M/S (g/m$^2$) are calculated. For the measurement, an operation of the main assembly of the recording device is stopped during operation of solid white printing, and the measurement is carried out for the developing roller or developing sleeve.

ADVANTAGES OF THE EMBODIMENTS OVER PRIOR-ART

Evaluation Method for Embodiment 1 and Comparison Examples 1-9

The image evaluation for investigating differences between the Embodiment 1 of the present invention and comparison examples 1-9, will be described.

Image evaluation in scheme 1 (FIG. 1 using the drum cleaner 8):

a) Evaluation of Fog Prevention:

Here, "fog" means the phenomenon that toner slightly adheres to the white (unexposed) areas, that is, the areas to which toner was not intended to be adhered, causing the resultant image to appear as if its white (blank) portions were soiled.

The amount of fog is measured in this manner. The optical reflectance of the white portion is measured by an optical reflectance measuring machine TC-6DS available from Tokyo Denshoku using a green filter, and the difference of the measurement from the reflectance obtained when a plane paper is measured, is used as the reflectance of the fog. In determination of the amount of the fog, the measurements are carried out at least 10 different points on the recording paper, and the average of the measurements is employed as the amount of the fog.

N: the amount of fog exceeds 2%.

F: the amount of fog is 1-2%.

G: the amount of fog is 0.5-1%.

E: the amount of fog is less than 0.5%.

The fog prevention evaluation is carried out for the initial 100 sheets, and after 3000 sheets printing. In the printing test, an image of lateral lines of image ratio of 5% is repeatedly continuously printed. If an image defect other than the defects which will be describe hereinafter occurs, the defect portion is excluded from the measurement to evaluate the fog only.

b-1) Fog Property Evaluation when the Remaining Toner Amount is Short:

With repetition of the printing test, the amount of the toner in the developing device decreases, and therefore, the image density of the lateral lines decreases, and in an extreme case, the lateral lines partly disappear. The fog prevention performance when the remaining toner amount decreases, the evaluation is made separately. In the printing test, when the above-described defect of the lateral line image, the fog prevention evaluation is made, and then, the developing device is dismounted from the recording device and is manually shook to feed the toner to the developing sleeve and to the developing roller. Thereafter, the developing device is set in the apparatus, and the fog prevention is evaluated. In such an image evaluation, the fog prevention evaluation is similarly made, and the worst fog is taken for the fog prevention evaluation.

b-2) Causes for the Fog, when the Remaining Toner Amount Decreases.

The supply of the non-magnetic toner onto the developing roller is effected by contacting a sponge-like supplying roller to the developing roller so as to provide a counterdirectional peripheral movements. Therefore, by the sliding contact between the developing roller and the supplying roller, the deterioration of the toner is remarkable with the result of reduction of the charging property. For this reason, the fog amount increases with increase the number of prints (particularly low duty printing) produced.

Furthermore, with such a toner supply mechanism, the toner replacement hardly occurs around the developing roller with the result of production of the region in which the toner does not circulate. On the other hand, the circulating toner deteriorates to a certain degree. When the cartridge is shaken in the case of toner shortage, the less deteriorated toner and such deteriorated toner are mixed together in the developing container, namely, the toner particles having different polarities are mixed with the result of remarkable increase of the fog amount.

This is because when such a mixture occurs, and the charging of the toner is effected, the undeteriorated toner has high charging property, and the deteriorated toner has hardly any charging, or has a polarity opposite to the regular polarity. The thus not charged or opposite polarity toner results in increase of the fog amount.

The toner of the opposite polarity leads to the fog, because the direction of force received by such opposite polarity toner is the opposite from the force received by the regular polarity, and therefore, the opposite polarity toner positively transfers onto the non-printing area.

In the case of the magnetic toner used, the toner is fed by the magnetic force, and therefore, the toner is not remarkably deteriorated. Even when the cartridge is shaken immediately before the toner shortage, there occurs no mixture of the toner particles having opposite polarities, therefore, the increase of the fog amount immediately before the toner shortage can be prevented.

c-1) Ghost Image:

The supply and removal performance of the developer is evaluated on the basis of development ghost. For this evaluation, the checking is made with ghost images appearing at intervals corresponding to the period of the rotation of the developing roller or the developing sleeve in consideration of the peripheral speeds of the developing roller and the developing sleeve and the process speed. The occurrence of the ghost image is discriminated in this manner. Solid black patch images of 5 mm square and 25 mm square are printed at the leading end of the sheet, and then, a halftone image is formed immediately after that. When the density difference between the halftone image portion and the previous solid black portion is recognized by visual observation, it is discriminated that ghost image occurs. The scanner machine used in the tests is a 600 dpi laser scanner. In the tests, the halftone image is represented by an image comprising 1 line extending in the main scan direction and subsequent non-printed 4 lines. The image thus provided, as a total, represents a half-tone image.

The image evaluation is made as follows:

N: the ghost images of both of the patches are recognized:

F: the ghost image of only one of the patches is recognized:

G: none of the ghost images of the patches is recognized:

The evaluations are carried out for initial 100 sheets.

c-2) Causes of Ghost Image.

The developing device of the embodiments of the present invention comprises a photosensitive drum and a developing sleeve pressed thereto, and it does not include a removing and supplying roller. In such a developing device, a portion of the elastic sleeve from which the toner is consumed in the immediately previous rotation, is supplied with a new toner, and the toner is fed to the regulating portion. When the solid black image is printed, more than 90% of the coated amount of the toner is consumed. Therefore, the toner deposited on the portion from which the toner has been consumed contains a large percentage of newly supplied toner. On the other hand, the toner on the portion from which the toner is not consumed in the immediately previous rotation, the toner returns to the supply portion as it is. Therefore, the toner deposited after this contains a relatively low percentage of the newly supplied toner. In this manner, the toner fed to the regulating portion involves the difference in the ratio of the new toner to the old toner, depending on the difference in the consumption in the previous rotation. When the toner in the upper toner layer and the toner in the lower toner layer are not exchanged, that is, when the toner is not sufficiently scraped off the sleeve surface, a uniform halftone image may involve a ghost image corresponding to the hysteresis of toner consumption in the previous rotation of the sleeve.

d-1) Hair Line Uniformity:

The image evaluation for this purpose is carried out on the basis of continuity of 1 dot line in the longitudinal and lateral directions. The scanner machine used in the tests is a 600 dpi laser scanner. The evaluations are carried out for both of one dot line extending parallel to the process advancing direction and one dot line extending parallel to the main scan direction of the laser scanning system. Such hair line image having a length of 2 cm is printed in each of the examples, and 100 lines are selected at random. An area of 200 μm square with one line at the center thereof, for each of the 100 points, is observed by an optical microscope. For each of the lines, a half-peak width of the density of the line is determined as the line width of the line. A standard deviation of the line widths is calculated for each direction. A line standard deviation ratio $\sigma v/\sigma h$ is obtained from the calculated line standard deviation σv for the process direction, and the calculated laser scanning direction standard deviation σh. Using the value thus obtained, the following evaluation is carried out:

N: the line standard deviation ratio σv/σh is less than 0.7 or more than 1.43:

F: the line standard deviation ratio σv/σh is not less than 0.7 and less than 0.8, or not less than 1.25 and not more than 1.43:

G: the line standard deviation ratio σv/σh is not less than 0.8 and less than 1.25.

The evaluations are carried out for initial 100 sheets.

d-2) Causes of Deterioration of Hair Line Uniformity.

In the magnetic non-contact development, there is a problem that hair line uniformities in the horizontal and vertical directions are different. With respect to the direction in which the magnetic chain moves in parallel with the advancing direction of the surface of the photosensitive drum during the developing operation, the hair line uniformity is good, but with respect to the direction perpendicular thereto, the line tends to intermittent.

e-1) Image Edge Defect:

The image edge defect means an image defect in which at a boundary between a high density portion and the low density portion the density difference there between is small.

For the image evaluation, a solid black image of 25 mm square is printed in the halftone image. In this evaluation, the halftone image is represented by an image comprising 1 dot and subsequent non-printed 4 dots in the main scan direction, and 1 dot and subsequent non-printed 4 dots in the subscan direction. The image thus provided, as a total, represents a half-tone image. At the edge portion between the half-tone portion and the solid black portion, the half-tone side at the edge portion is observed by an optical microscope, and the number of toner particles in 1 dot where the toner is agglomerated, are counted. Also, at a portion sufficiently away from the edge portion, the number of toner particles in 1 dot is counted, similarly. In the accounting of the number of toner particles in 1 dot, 15 dots are extracted at random, and the average of the numbers of the toner particles is represented as the number of toner particles in one dot.

N: the number of the toner particles at the edge is not more than 60% the number of the toner particles at a portion sufficiently away from the edge portion.

G: the number of the toner particles at the edge is more than 60% the number of the toner particles at a portion sufficiently away from the edge portion.

The evaluations are carried out for initial 100 sheets.

e-2) Causes of the Image Edge Defect.

Figure 11:
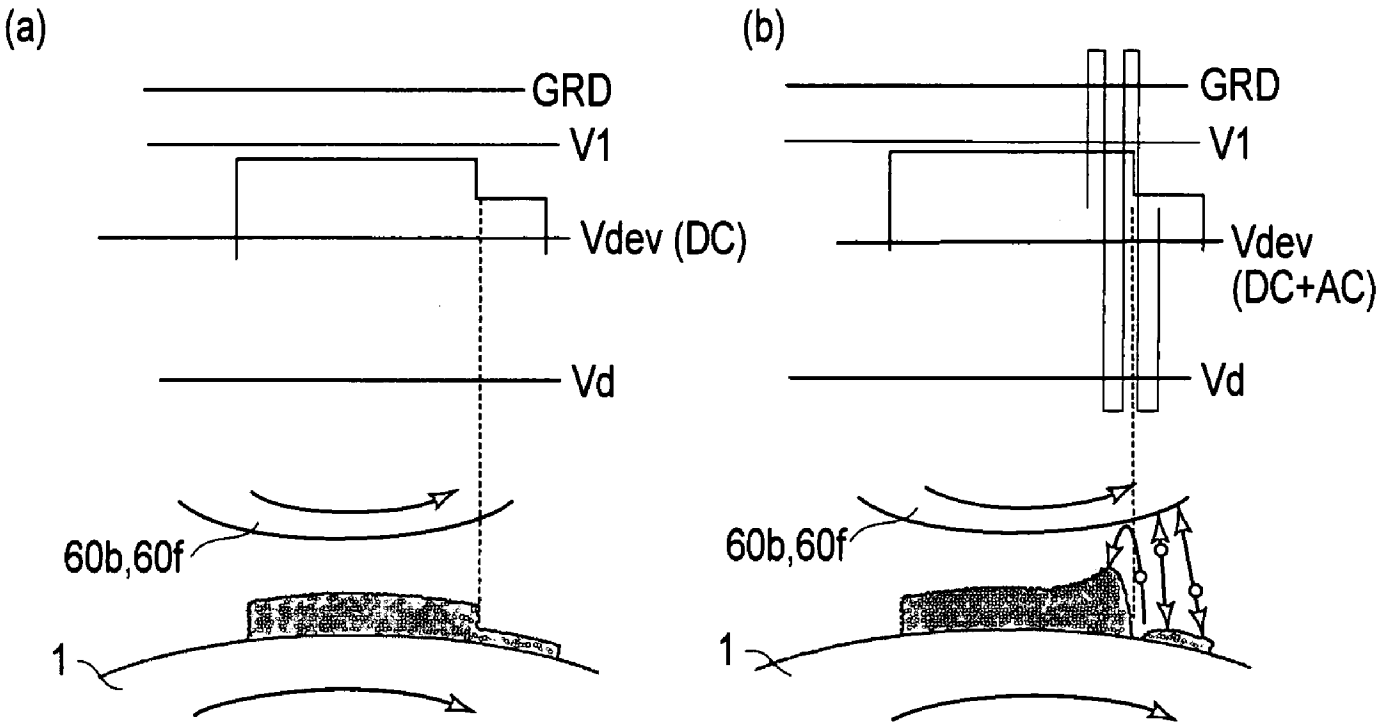
FIG. 11 illustrates a mechanism of occurrence of an edge defect.
Figure 12:
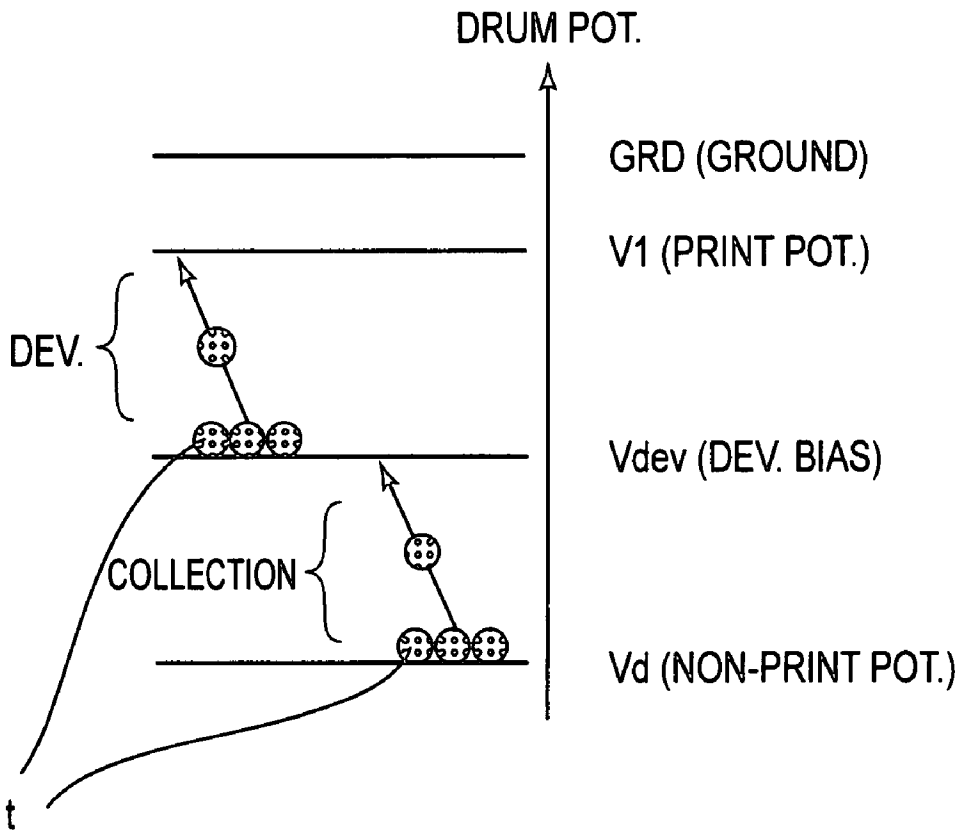
FIG. 12 illustrates a mechanism of simultaneous development and cleaning mechanism.

Referring to FIG. 12, the description will be made as to image edge defect factors. When the peak-to-peak voltage Vpp of the AC voltage is large, reciprocation of the toner particles occurs in the developing zone. At this time, if there is a printing area at which the density difference is large, as shown in FIG. 11, the toner particles reciprocating in the neighborhood of the boundary, the toner articles are attracted toward the printing area having the high density, and therefore, the density of the low density part lowers than expected at the boundary portion.

f-1) Solid White Image Defect:

This image evaluation is made on the basis of an image defect occurring at the interval equal to the cyclic period of the developing sleeve or developing roller. The cyclic period of development is accurately calculated in consideration of the process speed and the peripheral speed ratio between the photosensitive drum and the developing sleeve. Then, the image defect appearing at the cyclic period is extracted, and is checked. The size of the image defect is approximately 2-3 mm in width and 3-10 mm in length, the partial optical density is approximately 0.3 to 1, and such image defects are separately checked. Clear evaluation is possible on the basis of presence and absence of the defects. The evaluation is made as follows:

N: there is an image defect:

G: there is not image defect:

For this evaluation, 10 solid white images are continuously printed.

f-2) Causes of Solid White Image Defect.

For a solid white image, the toner is not consumed, so that amount of the toner returning to the supply portion is large. In such a case, if the old and new toner particles are not sufficiently exchanged, the distribution of the specific charge of the toner coating layer and/or the thickness of the coating layer, after passing by the regulating blade, tends to be uneven. If the distribution of the specific charge is not uniform, there exists locally the toner having a specific charge which is higher than a regular value. Such toner has a strong depositing force toward the surface of the sleeve with the result of difficulty of replace. Thus, by continuous printing of solid white images, this remarkably tends to arise. When new toner is supplied to the portion having such high specific charge toner, the charging property of the toner relative to the surface of the sleeve decreases, with the result of not proper specific charge. As a result, there appears, on the surface of the toner coating layer, a certain amount of toner having a low specific charge or opposite polarity charge, and therefore, when the developing operation is effected with the sleeve being urged or contacted to the surface of the drum, such toner is deposited on a non-printing portion (white) of the drum, with the result of the solid white image defect. When the thickness non-uniformity occurs, there appears a portion having a larger coating amount of the toner as compared with the portion therearound. At the portion where the coating amount is larger, the amount of the toner returning to the supply portion is larger, with the result of deteriorated toner replacement or exchange. At the portion where the coating amount is large, the toner is subjected to a locally higher pressure between the photosensitive drum and the sleeve, so that mobility is low or nothing in a part of such high pressure portion, and therefore, the toner there is not consumed and reaches the supply portion, where the replacement of such toner with the newly supplied toner is difficult because of the high physical depositing force between the toner and the elastic sleeve surface. Therefore, when the new toner is supplied from the supply portion, the charging property of the toner relative to the elastic sleeve is not enough, with the result of production of toner having a low specific charge or opposite polarity charge. This becomes a cause of solid white image defect.

Particularly, in an image forming apparatus of a cleaner-less system according to scheme 2, when a solid white image defect occurs, the transfer roller is contaminated, even to such an extent that charging becomes impossible due to the contamination of charging roller, and a whole surface black image may be produced, and the transfer material may be wrapped on a fixing device, resulting in apparatus failure. For this reason, the suppression of the solid white image defect is important in the cleaner-less system.

g-1) h) Halftone Image Defect 1:

For the purpose of this image evaluation, halftone images are printed, and the evaluation is made on the basis of the number of the image defects therein. The scanner machine used in the tests is a 600 dpi laser scanner. In the tests, the halftone image is represented by an image comprising 1 line extending in the main scan direction and subsequent non-printed 4 lines. The image thus provided, as a total, represents a half-tone image.

In this example, the uniformity of the halftone image is particularly noted, and a white spot or a black spot having a size of 0.3 mm or larger is taken into account.

G: the number of white dots or black dots having a diameter of not less than 0.3 mm in the halftone image is larger than 5:

F: the number of white dots or black dots having a diameter not less than 0.3 mm in the halftone image is 1-5:

G: the number of white dots or black dots having a diameter not less than 0.3 mm in the halftone image is 0:

The evaluation is made for the prints after 2000 sheets text printing.

g-2) Causes of Halftone Image Defect 1.

When an agglomeration of toner or introduction of foreign matter occurs, the coating layer is disturbed, and the defect having the size corresponding to the size of the agglomeration or foreign matter is produced in the halftone image.

h) Solid Black Image Density Evaluation:

With the image forming apparatus of scheme 1, a solid black image is printed on the whole surface of the sheet, and the optical reflection density thereof is measured by a densitometer RD-1255 available from Macbeth Corp. The evaluation is as follows:

N: the density is less than 1.2:

F: the density is 1.2-1.4:

G: the density is not less than 1.4:

The density evaluation is carried out at the initial 100th print, and at 3000th print. In the printing test, an image of lateral lines of image ratio of 5% is repeatedly continuously printed. The evaluation ambience is 15.0° C. and 10% Rh.

i-1) Image Evaluation of Tone Gradient:

The tone gradient is evaluated with respect to the image forming apparatus of Embodiment 1. The scanner machine used in the tests is a 600 dpi laser scanner. Twelve longitudinal stripes each having a width of 1 cm, without gap between adjacent ones of stripes are printed. One end is a solid white longitudinal stripe, and the other end is a solid black longitudinal stripe. The rest 10 strips are halftone images provided by dots with different area ratios in 10 grades. The evaluation is carried out by visual observation for the 12 longitudinal stripes under the following references:

N: the number of discriminatable longitudinal stripes is not more than 7:

F: the number of discriminatable longitudinal stripes is 8-10:

G: the number of discriminatable longitudinal stripes is 11 to 12.

The tone gradient evaluation is carried out after initial 100 prints. In the printing test, an image of lateral lines of image ratio of 5% is repeatedly continuously printed.

i-2) Causes of Deterioration of the Tone Gradient Reproduction.

If the uniformity of the specific charge of the toner deteriorates, the electrical force applied to the respective toner particles on the developing sleeve to transfer the toner onto the same latent image potential of the surface of the photosensitive drum, becomes non-uniform. In the contact developing system, as a result, a small difference in the latent image potential is not reproduced faithfully.

On the other hand, in a non-contact type developing system, in order to cause the toner jump from the developing sleeve to the photosensitive drum, an application of an intensity of electric field beyond a predetermined level is required. In other words, a threshold which is small in the contact developing system, is large in the non-contact type developing system, and therefore, the toner is not transferred as smoothly as in the contact developing system. Furthermore, with the existence of such a threshold, a ratio of electrical force received by the respective toner particles on the developing sleeve with respect to the low difference latent image potential on the photosensitive drum, is smaller than the ratio of the latent image potential. In such a state, however, inclusion of AC voltage in the developing bias effective to reciprocate the toner particles is contributable to realize high gradation development, that is, a reproduction of tone gradation faithful to the latent image. However, when the uniformity of the charge distribution of the toner is high, the threshold is sharp, with the result of binary type toner jump, so that tone gradation may be binary type.

The description will be made as to various image evaluations in the image forming apparatus of scheme 2 (cleaner-less system).

A-1) Toner Collection Property in Cleaner-less System:

For this evaluation, a solid black image of 30-50 mm is printed at the leading end of the printed image area, and thereafter the image recording device is operated to print an evaluation pattern having a solid white image and is stopped during the printing operation. The timing of the stop is the instance when the center position of the solid black image at the leading end comes to the developing zone. The reflectance of the toner deposited on the surface of the photosensitive drum is measured at each of the points before and after development. The toner collection efficiency can be evaluated on the basis of a ratio between the reflectances. Actually, the toner on the drum is transferred on a transparent tape, which in turn is stuck on a plain paper, and the net reflectance of the toner is measured in the same manner as with the fog measurement.

N: the collection rate is less than 30%:

F: the collection rate is less than 50%:

G: the collection rate is not less than 50%:

The evaluations are carried out for initial 100 sheets.

A-2) Causes of Deterioration of Toner Collection Property in Cleaner-less System:

The image forming apparatus of scheme 2 is significantly different from the image forming apparatus of scheme 1 in that drum cleaner is omitted, and the untransferred toner is collected in the developing device to reuse the toner. In this embodiment, the developer carrying member 440 is press-contacted to the photosensitive drum 1 at a predetermined pressure and is supplied with a developing bias voltage. Simultaneously with developing operation (visualization) with toner, for the electrostatic latent image formed on the surface of the photosensitive drum, the residual toner remaining on the non-exposed portion (white background portion) is collected by the developing device. As shown in FIG. 12, using the potential difference between the developing bias and the printing portion (light portion potential Vl in the case of solid black image), the toner is transferred from the developer carrying member onto the photosensitive drum to effect the reverse development, and using the potential difference between the developing bias and the non-printing portion potential Vd (dark potential), the photosensitive drum is transferred back onto the developer carrying member.

In addition, by the press-contact between the photosensitive drum and the developer carrying member, the distance therebetween is reduced so that field intensity is increased to enhance the performance of the simultaneous development and collection.

In addition, the press-contact structure is effective to assure the development and collecting operation by the electric field, since the effective area of the development nip increases, and it is promoted to make the charge of the returning toner negative, and in addition, the returning toner is loosened, since the effective area of the development nip increases.

On the other hand, when the developer carrying member is opposed to the photosensitive drum without contact thereto, the distance therebetween is large, and therefore, the magnetic collection force and the electrical collection force are relatively weaker. This deteriorates the collection efficiency.

In the case that photosensitive drum and the developer carrying member are press-contacted to each other, the pulling force produced by the contact of objects, van der Waals force is quite the same between the drum and the toner, between the toner and the developer carrying member, and between the toner and the toner. Therefore, the forces are not a cause of deterioration of the collection property. However, in the case that developer carrying member is not contacted to the drum, such a force applies only between the drum and the returning toner, thus retarding the removal of the toner from the photosensitive drum, and deteriorating the collection property.

B-1) Halftone Image Defect 2 (Image Forming Apparatus of Scheme 2):

Similarly to the image forming apparatus of scheme 1, the halftone image defect prevention evaluation is carried out for the image forming apparatus of scheme 2.

B-2) Causes of Halftone Image Defect 2:

Similarly to the halftone image defect 1, the halftone image defect 2 is caused by the toner agglomeration or foreign matter introduced. However, in the image forming apparatus of cleaner-less system according to scheme 2, the halftone image defect 2 tends to occur since the returning toner is collected. Particularly, when the supplying roller is contacted to the developing roller and is rotated counterdirectionally, as in the non-magnetic contact development, the physical stress is high in the contact portion. With such a structure, the agglomeration is easily produced due to the returning toner or deteriorated toner, with the result of remarkable halftone image defect 2.

C-1) Halftone Image Defect by Paper Dust:

In the image forming apparatus of scheme 2, the paper dust (paper fiber) having departed from the recording paper may be deposited on the photosensitive drum and may be introduced in the developing device by way of the charging device. If this occurs, the paper dust is engaged with the elastic roller, with the result of image defect produced intermittently in the advancing direction of the process at a period corresponding to the circumference of the elastic roller. Such defects are checked separately from the halftone image defect B).

The image defect having a width of not less than 0.3 mm and a length of not less than 2 mm is recognized as the defect, and the number of such defects is counted.

G: the number of the defects in the halftone image exceeds 5:

F: the number of the defects is 1-5:

G: the number of the defects is 0:

C-2) Causes of Halftone Image Defect by Paper Dust:

When the paper dust contained in the returning toner is introduced in the developing device, the paper dust is deposited on the sponge-like supplying roller for supplying the toner to the developing roller, with the result of deterioration of the removing and supplying property. When the paper dust is accumulated, the toner layer on the developing roller is disturbed with the result of production of defect extending in the rotational direction of the developing roller.

D) Solid Black Image Defect:

For this image evaluation, a solid black image is printed, and the evaluation is made on the basis of the number of defects in the images.

In this example, the defect not less than 0.3 mm is taken into account.

N: the number of white dots having a diameter of not less than 0.3 mm in the solid black image is larger than 50:

F: the number of white dots having a diameter of not less than 0.3 mm in the solid black image is larger than 10-50:

G: the number of white dots having a diameter of not less than 0.3 mm in the solid black image is less than 10:

The evaluation ambience is 15.0° C. and 10% Rh. For the evaluation, three solid black images are printed after 24 hours elapse after 1000 sheets print. The defect is represented by the one among the three prints that involves most defects.

Figure 13:
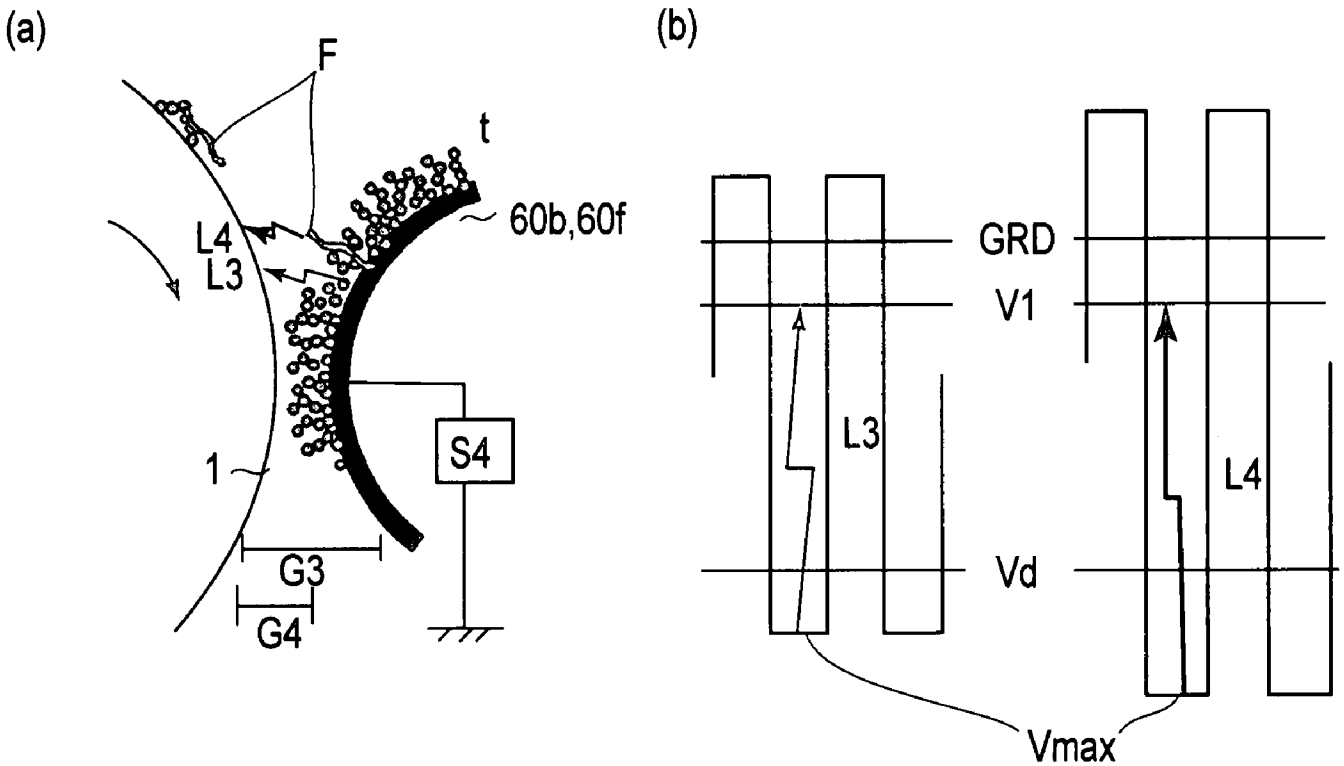
FIG. 13 illustrates a mechanism of occurrence of a solid black image defect.

D-2) Causes of Solid Black Image Defect:

As shown in FIG. 13, when the solid white image is developed under the application of the AC voltage in the developing bias, the difference between the surface potential of the image bearing member (light potential Vl) and the maximum value (Vmax, maximum of the absolute values) of the developing bias voltage value provides the maximum field intensity, and in such a situation, the leakage L3 is liable to occur.

The electrostatic latent image on the image bearing member 1 is disturbed at the portion where the leakage L3 occurs, and as a result, a part of potential (light potential Vl) of the solid white portion on the image bearing member 1 approaches to the dark potential (Vd) due to the leakage, and therefore, the toner the is not transferred onto the image bearing member 1 (reverse development). Then, a white spot appears at this portion on the image bearing member 1.

When the leakage occurs, a portion charging to Vmin appears on the photosensitive drum irrespective of the field intensity. When Vmax is large, the contrast (|Vmax-Vdc|) of the developing bias relative to the DC value Vdc is large, and therefore, the amount of toner transfer is large, and the white dot is very conspicuous.

Furthermore, In addition, if the paper dust included in the returning toner reaches the developing zone together with the toner ((a) of FIG. 13), the electrical leakage occurs through the paper dust. As shown (in a) of FIG. 13, when the paper dust F reaches the developing zone, the gap relative to the drum decreases from G1 to G2. If this occurs, the local field intensity applied to the paper dust increases (right side of (b) of FIG. 13), so that leakage tends to occur. Under a high temperature and high humidity ambience, the paper dust absorbs a relatively large amount of water, and therefore, the resistance is low. When an external electric field E is supplied at this time as shown in (c) of FIG. 13, the charge is offset, so that amount of electric charge increases at the free end portion of the paper dust to increase the tendency of leakage. For this reason, the liability of electrical leakage is larger in the cleaner-less system done in the system using the cleaner.

Table 1 shows results of evaluations in Embodiment 1 and comparison examples 1-9. The advantageous effects corresponding to the evaluation items will be described hereinafter.

TABLE 1

| | | | | Scheme 1 | | | | | | | | | Scheme 2 | | | |
|---|---|---|---|---|---|---|---|---|---|---|---|---|---|---|---|---|
| | *A | *B | *C | *D | *E | *F | *G | *H | *I | *J | *K | *L | *M | *N | *O | *P |
| *1 | 29 | 10 | 0.03 | G—G | G | G | G | G | G | G | G—G | G | G | G | G | G |
| *2 | 28 | 11 | 0.99 | G-N | G | F | G | G | N | G | G-F | F | G | G | F | G |
| *3 | 6 | 10 | 0.03 | G—G | G | G | N | N | G | G | G-N | G | N | G | G | N |
| *4 | 6 | 10 | 0.99 | G-F | G | F | N | N | G | F | F-N | G | N | F | F | N |
| *5 | 6 | 10 | 0.03 | N— | — | F | G | G | N | — | G— | N | F | — | — | G |
| *6 | 30 | 8 | 0.03 | G—G | G | G | N | N | G | G | G—G | N | N | G | G | N |
| *7 | 28 | 9 | 0.99 | G-F | G | F | N | N | G | G | G-F | F | N | G | G | N |
| *8 | 7 | 10 | — | G-F | F | F | N | G | G | G | G-F | G | F | G | G | G |
| *9 | 40 | 4 | — | E-F | N | G | G | G | G | F | G-F | G | G | N | N | G |
| *10 | 35 | 4 | — | G-F | F | G | G | G | G | G | G-F | G | G | F | N | G |

E: Excellent:
G: Good:
F: Fair:
N: No good:
*A: Q/M (μC/g)
*B: M/S (g/m$^2$)
*C: |Br|/|B|
*D: a) Fog prevention 100th-3000th (effects 1 and 2)
*E: b) Fog prevention (toner shortage) (effect 3)
*F: c) Ghost prevention (effect 4)
*G: d) Hair line uniformity (effect 13)
*H: e) Edge defect prevention (effect 14)
*I: f) Solid white defect prevention (effect 6)
*J: g) Half tone image defect prevention (effect 7)
*K: h) Solid black defect prevention 100th-3000th (effect 8)
*L: i) Gradation (effect 9)
*M: A) Collection property in cleanerless system (effect 17)
*N: B) Half tone image defect prevention 2 (effect 18)
*O: C) Half tone image defect (by paper dust) prevention (effect 19)
*P: D) Solid black defect prevention (effect 20)
*1: Embodiment 1: contact; elastic sleeve; in-between position regulation
*2: Comparison Example 1: contact; elastic sleeve; pole position regulation
*3: Comparison Example 2: non-contact; rigid sleeve; in-between position regulation
*4: Comparison Example 3: non-contact; rigid sleeve; pole position regulation
*5: Comparison Example 4: contact; rigig sleeve; in-between position regulation
*6: Comparison Example 5: non-contact; elastic sleeve; in-between position regulation
*7: Comparison Example 6: non-contact; elastic sleeve; pole position regulation
*8: Comparison Example 7: multi-pole;
*9: Comparison Example 8: non-magnetic toner
*10 Comparison Example 9: non-contact feeding roller (Advantages Over Prior Art)

The advantages of this embodiment over the comparison examples of the magnetic non-contact type developing system and the non-magnetic contact developing system.

(1-1) Comparison with the Magnetic Non-contact Type Developing System (Comparison Examples 2, 3):

The developing device of comparison examples 2, 3 (magnetic non-contact type developing system) involves deterioration of hair line uniformity and image edge defect. This is because comparison examples 2, 3 use magnetic chain formed by the magnetic field, and the hair line uniformity is influenced by the moving direction of the chain of the toner particles. In addition, the distance between the photosensitive drum and the developing sleeve is large, so that toner particles jump both in the image portion and the non-image portion by the AC electric field, with the result that toner is concentrated at the edge portions of the image, so that there is a density difference between the edge portion and the central portion. Furthermore, the solid black image density decreases with increase of operation time. The reason for this would be that externally added material of the toner is removed from the toner and is deposited on the developing sleeve. The externally added material removed from the toner is smaller than the toner particles, and therefore, the depositing force relative to the sleeve is large. In addition, the surface of the rigid member sleeve provides a strong mirror force, and therefore, when the charging property of the toner deteriorates with the deterioration of the toner with use, the material removed from the toner particles are particularly easily deposited on the surface of the sleeve. When they are deposited on the surface of the sleeve, the charging power between surface of the sleeve and the toner deteriorates, with the result of incapability of toner jump to the photosensitive drum, so that image density of the solid black image lowers.

In the case of the cleanerless image forming apparatus of scheme 2 used with the developing device of comparison examples 2, 3, the collection property of the toner remarkably deteriorates, as will be understood from Table 1. This is because in the non-contact type developing system, the force for removing the toner from the drum is weak, and the force for the collection is not enough.

Also, a solid black image defect appears. Under the normal conditions, no leakage of the developing bias occurs, but the leakage occurs under a high temperature and high humidity ambience, and it occurs also when foreign matter such as paper dust exists between the developing sleeve and the drum since the foreign matter may provide an electrical path.

(1-2) Comparison with Non-magnetic Contact Developing System (Comparison Example 8):

The developing device of comparison example 8 (non-magnetic contact developing system) will be described. When the developing device is used with an image forming apparatus of scheme 1, the fog prevention effects deteriorates with use. This is because the toner is subjected to a mechanical stress due to the supplying and removing action of the elastic roller 60*k*, with the result of deterioration of the toner charging property. Also, the density reduction due to toner deterioration appears. When the amount of the toner in the developing device decreases, the deteriorated toner and undeteriorated toner not included in the circulation, are mixed, so that toner charging property is remarkably deteriorated, and therefore, high density fog results. On the other hand, when the developing device of comparison example 8 is used in the image forming apparatus of scheme 2, the collection property (cleanerless collection property evaluation) is good, but a halftone image defect which would be attributable to the elastic roller appears. Such a defect is insignificant in the apparatus of scheme 1, but in the apparatus of scheme 2, a relatively larger amount of deteriorated toner is produced by the mechanical stress of the elastic roller as well as by the returning of the toner once subjected to the developing operation into the developing device after being further subjected to the image transfer and charging operations. The problem arising from the paper dust mixed into the developing device is also remarkable, and it is deposited on the surface of the elastic roller with the result of periodical image defects.

Advantageous Effects of this Embodiment Over the Prior-Art:

(1-3a) Image Forming Apparatus of Scheme 1:

On the other hand, the developing device of Embodiment 1 is used in good order with the image forming apparatus of scheme 1 or 2. First, the comparison will be made between Embodiment 1 and comparison example with respect to scheme 1.

As regards the hair line uniformity which has been a problem with comparison examples 2, 3, the apparatus of Embodiment 1 is free of such a problem, and the hair lines are uniform irrespective of the directions, so that uniform image reproduction is accomplished. The magnetic force in the developing zone is the same, and the formed magnetic field is the same, but the influence of the magnetic chains during the development is effectively eliminated since the amount of the toner and the amount of electric charge of the toner on the elastic sleeve are kept at a proper level, and since formation of long magnetic chains is suppressed by the application of the DC bias voltage. In addition, there is not image edge defect, and therefore, uniform image reproduction is accomplished. This is because the elastic sleeve is contacted to the photosensitive drum with the application of a DC voltage, and therefore, the concentration of the toner during the reciprocations of the toner is prevented.

The deterioration in the fog prevention performance in long term use, which is a problem in comparison example 8, is not observed. In comparison example 8, the elastic roller is used to remove and supply the toner, and therefore, there is a local high pressure portion due to the feeding operation of the elastic roller. The elastic roller is not used in this embodiment. The toner is fed by means of the magnetic force. The toner is fed by the magnetic force, so that toner is removed from and supplied to the developing sleeve under a small mechanical stress. As contrasted to the case of the elastic roller, the force is supplied without contact, and therefore, the size of the toner circulation range and the toner circulation efficiency are better than those in the comparison example. Thus, the toner can be removed and supplied with less stress imparted to the toner, so that toner feeding is possible without the problem of ghost image. For the same reason, toner agglomeration is not produced.

(1-3a) Image Forming Apparatus of Scheme 2:

The evaluations will be made with respect to the image forming apparatus of scheme 2 used with the developing device of Embodiment 1.

Since the elastic sleeve is disposed contacted to the photosensitive drum, the working area and the intensity of the electric field and/or magnetic field increases by the reduction of the distance between the elastic sleeve and the photosensitive drum. By this, the toner collection property from the residual toner deposited on the unexposed portion of the surface of the image bearing member is improved. In addition, the halftone image defect and the influence of the paper dust are at a satisfactory level, because the toner operation does not rely on an elastic roller but on a magnetic force. Furthermore, no solid black image defect which appears in comparison example 1 is observed. This is because although a large electric field is applied, the potential difference is not so large as to generate discharge.

(1-4) Comparison with Comparison Example 7:

It would be expected that supply and removing properties will be improved by the use of rotation magnetic force provided by the multi-pole magnet as in comparison example 7, but the result is poor ghost image property. In addition, the magnetic force oscillates in the regulating portion and in the developing zone, and therefore, the fog preventing performance is not good. The use of the multi-pole magnet is effective to slightly reduce the magnetic force, but the influence of the magnetic chains still remains with the result of poor hair line uniformity. On the other hand, since the contact DC development type is employed, the image edge defect and the collection property are improved because of the contact to the photosensitive member.

(1-4) Comparison with Comparison Example 9:

Comparison example 9 is similar to comparison example 8, but the toner removing and supplying means is modified in an attempt to satisfy both of fog prevention and ghost image prevention performance. Although the fog is slightly improved, it is still not sufficient. Since the removing member 60*j* is fixed, halftone image defect and the halftone image defect due to the paper dust are poor, particularly when it is used in an image forming apparatus of scheme 2. Since the fixed removing member is used, the defect is not periodical, but the defects in the form of stripes are observed. The developing device has been disassembled after the printing operation, and it has been found that there are deposited matter of paper dust and the like on the removing member. The reason why the halftone image defect is remarkable in the cleanerless type (scheme 2) than in the type (scheme 1) using the cleaner, would be that deterioration of the toner is promoted by the collected toner, or agglomeration of the toner is promoted around the foreign matter contained in the collected toner, with the result of production of the agglomerated toner.

(1-6) A Relation Between the Contact Position of the Regulating Blade and Magnetic Pole Arrangement:

Embodiment 1 is compared with comparison examples 1-6, and the relation between the contact position of the regulating blade and the arrangement of the magnetic poles will be considered.

(1-6a) The use with the Image Forming Apparatus of Scheme 1 is First Considered.

(1-6a-1) Fog Prevention Evaluation:

In the developing device of Embodiment 1, the blade regulation position is disposed between the adjacent poles (in-between arrangement) where the horizontal magnetic field is dominant, and in developing device of comparison example 1, it is disposed at a pole position where the perpendicular magnetic field is dominant. In comparison example 1, the fog is produced due to deterioration with operation. In order to provide a proper specific charge and proper toner coating layer with the pole position regulation, it is required to strengthen the blade drawing pressure as compared with the in-between regulation. In the case of the pole position regulation, the regulating force by the regulating blade is strong, and therefore, a mechanical pressure is applied to the toner with the result of remarkable acceleration of toner deterioration. This would be the reason for the worse fog.

Comparison example 2 and comparison example 3 both use the jumping development system, but are different in that former uses in-between position of the blade regulation and the latter use pole position regulation. The developing devices of comparison example 5 and comparison example 6 both use a developing sleeve with the elastic layer as in Embodiment 1 and comparison example 1, but the photosensitive drum and the elastic sleeve are not contacted but spaced from each other.

In comparison example 3 and comparison example 6 which are both of the non-contact type developing system, the regulation position is at the pole, and therefore, a certain degree of toner deterioration occurs similarly to comparison example 1. However, since the elastic sleeve is not contacted to the photosensitive drum, the jumping of the toner which has the low specific charge due to decrease of the charging power or which has the opposite polarity can be suppressed, so that increase of the fog is insignificant, and therefore, the fog increase is not as remarkable as in comparison example 1.

From the foregoing, the fog amount is remarkably suppressed by the in-between positioning of the regulation position, according to this embodiment.

(1-6a-2) Ghost Image Prevention Evaluation:

The results of evaluation with respect to the prevention of the ghost image production, will be described. With the in-between position regulation in Embodiment 1, comparison example 2 and comparison example 5, the ghost image prevention evaluations are good, and in comparison example 1, comparison example 3 and comparison example 6 wherein the pole position regulation is used, ghost image is slightly observed.

Generating mechanism of ghost image defect will be described. The developing device of the Embodiment 1 of the present invention comprises a photosensitive drum and a developing sleeve pressed thereto, and it does not include a removing and supplying roller for removing the toner from the developing roller and supplying the toner onto the developing roller. In such a developing device, a portion of the elastic sleeve from which the toner is consumed in the immediately previous rotation, is supplied with a new toner, and the toner is fed to the regulating portion. When the solid black image is printed, more than 90% of the coated amount of the toner is consumed. Therefore, the toner deposited on the portion from which the toner has been consumed contains a large percentage of newly supplied toner. On the other hand, the toner on the portion from which the toner is not consumed in the immediately previous rotation, the toner returns to the supply portion as it is. Therefore, the toner deposited after this contains a relatively low percentage of the newly supplied toner. In this manner, the toner fed to the regulating portion involves the difference in the ratio of the new toner to the old toner, depending on the difference in the consumption in the previous rotation. By enabling the removal and supply of the toner, that is, enabling sufficient replacement between the toner in the upper layer and the toner in the lower layer immediately before passing through the regulating portion and during the passing therethrough, thus, providing a uniform distribution of the amount of the charge of the new and old toner particles, the layer of the toner particles after passing through the regulating portion have uniform amount of charge irrespective of the hysteresis of toner consumption, so that ghost image in the uniform halftone image can be effectively prevented. If such removal and supply of the toner is not sufficient, the ghost image defect appears on a uniform half-tone image print.

In addition, the raising property of the charging of the newly supplied toner up to a proper specific charge level, is also required.

By employing the in-between position regulation, the magnetic confining force in the regulating portion is weakened, so that exchange between the old and new toner particles, that is, the removing and supplying property is improved, thus suppressing the ghost image defect. As a result, even in comparison example 2 and comparison example 5 wherein the non-contact type developing system is used in which the development efficiency is low, the similar effects are provided, and therefore, uniform half-tone images are formed.

On the other hand, in comparison example 4, a rigid member sleeve is pressed against the photosensitive drum, and the ghost image defect slightly appears. In comparison example 4, by contacting the sleeve to the photosensitive drum, the development efficiency is enhanced, to such an extent that no sufficient replacement of toner is provided only by the in-between position regulation, and therefore, the image defect slightly appears.

In other words, in the system where the development efficiency is high, the in-between arrangement alone is not sufficient in order to improve the ghost image prevention. Thus, it is necessary to enhance the toner replacement or exchange property and uniform charging property. In view of this, the use is made with the elastic sleeve which has an elastic layer having a dielectric constant lower than that of the rigid member sleeve having a metal surface, thus improving the ghost image defect prevention effect. A mirror force between a point charge and a parallel flat plate is known as proportional to $P=(\epsilon-1)/(\epsilon+1)$, where $\epsilon$ is a dielectric constant. The mirror force $F=P\times 1/(4\pi\epsilon 0)Q^2/(2a)^2$. Where Q is an amount of electric charge of the point charge, a is a distance between the point charge and the parallel flat plate, and $\epsilon 0$ is a dielectric constant in vacuum.

Dielectric constant $\epsilon$ of a metal is infinity, and P=1. On the other hand, the dielectric constant $\epsilon s$ of the elastic layer in Embodiment 1 is 6.5, and P=0.73, which is 0.73 times that of metal, and therefore, the mirror force F can be reduced. Thus, in the system of this embodiment, the magnetic force is reduced, and therefore, the confining force between the toner and the sleeve is reduced, thus improving the replacement property, and in addition, by reducing the mirror force between the elastic layer and the toner, passing of the low specific charge toner through the regulating blade is suppressed. Accordingly, after passage of the regulating blade, the toner layer is formed with the proper and uniform electric charge. Furthermore, by employing the in-between positioning in which the blade regulation position is between adjacent magnetic poles, the depositing force between the surface of the elastic sleeve and the toner is remarkably reduced, by which an additional advantage is provided. The confining force of the toner having a low specific charge toward the sleeve surface is magnetically and electrically small in the regulation position. Therefore, such toner is relatively easily pulled back by the magnetic field at the supply portion which is disposed upstream of the regulation position. This improves the replacement property of the toner layer. For this reason, in the system of the present invention, the ghost image defect is suppressed.

(1-6a-3) Solid White Image Defect:

The solid white image defect will be described. In comparison examples 2-3 and comparison examples 5-6, wherein the non-contact development system is used, satisfactory images are provided. On the other hand, in comparison example 1 and comparison example 4, wherein the contact developing system is used, the solid white image defect appears. The mechanism of production of solid white image defect will be described.

For a solid white image, the toner is not consumed, so that amount of the toner returning to the supply portion is large. In such a case, if the old and new toner particles are not sufficiently exchanged, the distribution of the specific charge of the toner coating layer and/or the thickness of the coating layer, after passing by the regulating blade, tends to be uneven. If the distribution of the specific charge is not uniform, there exists locally the toner having a specific charge which is higher than a regular value. Such toner has a strong depositing force toward the surface of the sleeve with the result of difficulty of replace. Thus, it is a phenomenon which is enhanced by continuous solid white printing. When new toner is supplied to the portion having such high specific charge toner, the charging property of the toner relative to the surface of the elastic sleeve decreases, with the result of not proper specific charge. As a result, there appears, on the surface of the toner coating layer, a certain amount of toner having a low specific charge or opposite polarity charge, and therefore, when the developing operation is effected with the elastic sleeve being urged or contacted to the surface of the drum, such toner is deposited on a non-printing portion (white) of the drum, with the result of the solid white image defect. When the thickness non-uniformity occurs, there appears a portion having a larger coating amount of the toner as compared with the portion therearound. At the portion where the coating amount is larger, the amount of the toner returning to the supply portion is larger, with the result of deteriorated toner replacement or exchange. At the portion where the coating amount is large, the toner is subjected to a locally higher pressure between the photosensitive drum and the elastic sleeve, so that mobility is low or nothing in a part of such high pressure portion, and therefore, the toner there is not consumed and reaches the supply portion, where the replacement of such toner with the newly supplied toner is difficult because of the high physical depositing force between the toner and the elastic sleeve surface. Therefore, when the new toner is supplied from the supply portion, the charging property of the toner relative to the elastic sleeve is not enough, with the result of production of toner having a low specific charge or opposite polarity charge. This becomes a cause of solid white image defect.

In comparison example 4, the solid white image defect appears. The rigid member sleeve of comparison example 4 is not provided with an elastic layer. Therefore, the pressure applied to the toner between the photosensitive drum and the rigid member sleeve is very high. As a result, even with the non-uniformity of very small amount of toner coating, a stationary or less mobile portion tends to appear on the rigid member sleeve, and this would be the cause of the solid white image defect. As discussed in the ghost image prevention evaluation, the toner replacement property is poorer than in the system of the present invention where the use is made with the elastic layer. This would be the reason why the solid white image defect tends to appear.

In comparison example 1, the magnetic feeding force is strong in the regulating portion because of the employment of the pole position regulation, so that toner easily passes through the regulation blade portion magnetically. By this, the distribution of the charge of the toner layer after the regulating blade passing deteriorates. In addition, the replacement property of the toner deteriorates. For this reason, the formation of the coating layer is unstable, and the non-uniformity of the charge distribution and the non-uniformity of the amount of the coating arise with the result of solid white image defect.

On the other hand, in Embodiment 1, the images are good without the solid white image defect. Since the surface of the sleeve is an elastic layer, the pressure between the photosensitive drum and the elastic sleeve is reduced, and the solid white image defect is suppressed even upon arising of the non-uniformity of charge distribution of the toner layer and/or non-uniformity of toner coating amount. In addition, similarly to the effect of suppression of the ghost image defect, by the setting of the regulation position between the magnetic poles, the magnetic confining force is reduced at the regulating portion. Furthermore, by the provision of the elastic layer having a low dielectric constant, the mirror force is reduced, so that only the toner that has a proper specific charge is allowed to pass by the regulating blade. By doing so, the replacement property of the toner and the uniform in the distribution of the specific charge are improved. Moreover, by reducing the magnetic and electrical depositing force between the toner and the elastic sleeve at the position of the regulating blade portion, there is provided a pulling-back force toward the supply portion by the magnetic field at the supply portion, by which the replacement property is improved. By the above-described advantages, the solid white image defect can be remarkably suppressed according to the present invention.

(1-6a-4) Halftone Image Defect 1:

The description will be made as to the halftone image defect 1. Since comparison example 2 uses the magnetic non-contact type developing system and the in-between regulation, halftone image defect prevention is enough, but comparison example 3 slightly involves the halftone image defect. The halftone image defect occurring with the use of the image forming apparatus of scheme 1 is considered as hardly occurring in the case that no removing and supplying roller is used as in comparison example 8. However, in comparison example 3, the pole position regulation and rigid member sleeve are employed, the replacement of the toner and uniformity of the charge distribution of the toner are not enough, so that introduction of small foreign matter and agglomeration of toner occurs, and black spots or white spots appear in the halftone image. On the other hand, in Embodiment 1, comparison examples 1, 2 and comparison examples 4-6, at least one of in-between regulation and elastic layer is employed, and therefore, the halftone image defect does not appear.

In the system of this embodiment, the in-between regulation and elastic sleeve are very effective to suppress, the image defects attributable to the introduction of foreign matter and agglomeration of the toner.

(1-6a-5) Solid Black Density Evaluation:

The results of solid black image density evaluation will be described. In comparison example 4, an insignificant density decrease is observed at 100th print. The factors of the solid black image density decrease in comparison example 4 include rising of the specific charge of the toner beyond a proper level of the specific charge. The mechanism of the density decrease due to the rising of the specific charge will be described. When the specific charge of the toner rises beyond the proper range, the electrical depositing force between the toner and the surface of the sleeve becomes great, more particularly, the depositing force between the lower part of the toner coating layer and the sleeve surface becomes great, the lower part is not replaced with the upper layer constituted by the newly supplied fresh toner. This results in production of an upper toner layer of the toner having specific charges which are lower than the proper specific charge level, and results in reduction of the image density. Particularly, under a low temperature and low humidity conditions, the specific charge tends to rise, and therefore, this may remarkable appears.

In comparison example 4, the pole position regulation is used, and therefore, the toner replacement is not enough. In addition, since the rigid member sleeve is used, the mirror force between the toner and the surface of the sleeve is strong, and the toner having high specific charge tends to stagnate on the surface of the sleeve. This is considered as the cause of the insignificant density reduction at the initial stage of the print. In Embodiment 1, comparison examples 1, 2 and comparison example 4-6, at least one of the surface elastic layer and in-between regulation is employed, and therefore, the density reduction is not observed. In the system of the embodiment, there is provided an elastic layer at the surface of the sleeve, and the in-between regulation is employed, and therefore, the toner replacement performance is high so that non-uniformity of the charge distribution is stably small, and the specific charge of the toner particles is stably proper in the toner layer. Therefore, the effect of suppressing reduction of the solid black density is remarkably high in the system of this embodiment.

The solid black density image evaluation after 3000 prints will be described. In comparison examples 1, 3, 6, the image density reduces with prints as compared with the initial density. The mechanism of the density reduction will be considered. In comparison examples 1, 3, 6, the pole position regulation is employed, and therefore, the toner deterioration is promoted. Therefore, the externally added material is removed. The externally added material which has a particle size smaller than that of the toner, is easily deposited on the surface of the sleeve. In addition, since the pole position regulation is employed, the replacement of the toner reduces, and therefore, the material removed selectively tends to deposit on the surface of the sleeve. If the fine particles other than the toner particles are deposited on the surface of the sleeve, the charging property between the toner and the sleeve surface deteriorates. As a result, the toner specific charge reduces with the result of difficulty of the toner transfer onto the photosensitive drum, so that solid black density decreases. On the other hand, comparison example 3 involves the reduction of the density despite the use of the in-between regulation. The reason for this would be the deposition of the removed externally added material on the sleeve surface. Since comparison example 3 uses the rigid member sleeve, the toner replacement performance is worse than in the case of the sleeve having the surface elastic layer. In addition, since the in-between regulation is employed, the toner deterioration is slight, but a certain amount of the externally added material is removed. The removed externally added material has a small particle size, and in addition, the mirror force is great since the rigid member sleeve which has a high dielectric constant is used. Therefore, as compared with the case of the use of an elastic layer, the deposition of the removed externally added material onto the sleeve is promoted. As a result, the solid black density reduction occurs.

In this embodiment using the in-between position regulation and the sleeve having a surface elastic layer, the solid black density is stably enough from the initial stage to the later stage even under the low temperature and low humidity ambience conditions which tend to cause high toner specific charge.

(1-6a-6) Tone Gradient:

The results of image evaluation with respect to the tone gradient will be described. Comparison example 1 which uses the contact developing system will be described. In comparison example 1, the tone gradient insignificantly reduces. The reason would be that pole position regulation slightly reduces the uniformity of the toner specific charge in the toner coating layer as compared with Embodiment 1, and therefore, the tone gradation reduces. When the uniformity of the specific charge lowers, the electrical forces applied to the toner particles on the sleeve in the direction of transfer to the same latent image potential on the surface of the photosensitive member, become uneven. In the contact developing system, as a result, a small difference in the latent image potential is not reproduced faithfully. In the contact developing system used in the present invention, the toner layer has a uniform distribution of the charge, so that latent image can be faithfully developed.

The non-contact type developing system used in comparison examples 2, 3, 5, 6 will be described. Comparison examples 2 and 3 use a jumping development system, and the tone gradation is good.

On the other hand, in comparison examples 5, 6 where the developing sleeve is opposed to the photosensitive drum (non-contact), the developed images are binary-like, namely, the tone gradation is remarkably low. The reason will be considered. In order for the toner to jump from the sleeve to the drum in the non-contact type developing system, it is required that electric field beyond a predetermined intensity is applied. In other words, a threshold which is small in the contact developing system, is large in the non-contact type developing system, and therefore, the toner is not transferred as smoothly as in the contact developing system. Furthermore, with the existence of such a threshold, a ratio of electrical force received by the respective toner particles on the developing sleeve with respect to the low difference latent image potential on the photosensitive drum, is smaller than the ratio of the latent image potential.

In such a state, however, inclusion of AC voltage in the developing bias effective to reciprocate the toner particles is contributable to realize high gradation development, that is, a reproduction of tone gradation faithful to the latent image. For the purpose of smooth reciprocation of the toner particles, the threshold is desirably broad. The specific charge of toner in comparison examples 2, 3 employing the jumping development system, is as small as 6 μC/g, and the width of the distribution of the toner charge is wide, and therefore, the threshold is broad. This makes the toner reciprocation smooth, thus improving the tone gradation.

On the other hand, the specific charge in comparison examples 5, 6, is as high as 30 μC/g approx., and the elastic layer is employed, and therefore, the uniformity of the toner specific charge in the toner layer is high. The higher the uniform of the specific charge, the sharper the threshold, and the toner transfer motion becomes binary-like (all or nothing fashion). As a result, the ratio of the forces received by the toner particles on the sleeve relative to the latent image potentials a difference of which is small, is small, with the result of reduction of the tone gradation. In comparison example 5 which employs the elastic layer and the in-between position regulation, the uniformity of the toner specific charge in the toner layer is improved, the developed images are binary-like more than in comparison example 6.

In comparison example 4, the tone gradation is not good, despite the use of the contact development and the in-between position regulation, because the sleeve is a rigid member sleeve and because the jumping development system is used, the specific charge of the toner is low, and the distribution of the specific charge is broad, with the result that developed image is not faithful to the latent image potential.

From the foregoing, in order to provide a satisfactory tone gradation in the contact developing system, uniform distribution of the specific charge is desirable. In the contact developing system of the system of the embodiment, the magnetic confining force is lowered at the regulating portion by the employment of the in-between position regulation, the low specific charge toner is prevented from passing by the regulating blade due to the strong magnetic confining force. The provision of the elastic layer is effective to reduce the electrical depositing force between the surface of the elastic sleeve and the toner, thus suppression the low specific charge toner from passing by the regulating blade. Therefore, only the toner having the suitable property specific charge is selectively passed through the regulating portion. With the foregoing settings, a uniform distribution of the specific charge is accomplished, and therefore, the satisfactory tone gradation is accomplished.

(1-6b) The Case of the Image Forming Apparatus of Scheme 2 will be Described.

(1-6b-1) Collection Property in Cleanerless System and Solid Black Image Defect:

The toner collection property in the cleanerless system, in comparison examples 2, 3, 5, 6 which use the non-contact type developing system, is not good, and in Embodiment 1 and comparison example 1 which use the contact development system, is good. However, in the developing device of comparison example 4 which uses the contact development system, the collection property is slightly poor. The reason would be the use of the rigid member sleeve which may leads to unstable toner layer formation and the low specific charge. The solid black image defect occurs due to the production of leakage by the paper dust since the non-contact development is used, and since the developing bias includes an AC voltage. On the other hand, in Embodiment 1 and comparison examples 1, 4, there is no leakage due to the paper dust, and the solid black image defect does not appear, so that good solid black image is provided.

Halftone Image Defect 2 and Halftone Image Defect Due to Paper Dust:

In Embodiment 1 and comparison examples 2, 5, which use in-between position regulation, the halftone image defect 2 and the halftone image defect due to the paper dust are not observed. This is so even if the toner agglomeration is produced by the returning toner or even if the foreign matter, paper dust or the like is introduced, because the in-between position regulation enhances the toner replacement performance and because the toner supply is effected by the magnetic force. In addition, even if the paper dust is introduced, the magnetic force dominantly feeds the toner. In comparison examples 1, 3, 6 which use the pole position regulation, not all of them are unsatisfactory. The difference will be described. In comparison example 1, the pole position regulation is used, and therefore, the production of toner agglomeration attributable to the returning toner and the foreign matter and reduction of replacement, produces the halftone image defect due to the paper dust. However, as regards the toner agglomeration, the provision of the elastic layer reduces the adherence between the toner and the surface of the elastic layer and is effective to prevent the image defect. On the other hand, similarly to the comparison example 1, the halftone image defect does not result despite the fact of use of the pole position regulation. The reason would be that returning toner collection property is poor because of the use of the non-contact type developing system by comparison example 6. If the collection property is poor, the amount of the returning toner is small, and simultaneously, the amount of the paper dust included in the returning toner is small. Therefore, the halftone image defect does not result. On the contrary, in comparison example 1, the collection property of the returning toner is high, and the influence of the returning toner and the paper dust is significant, with the result of halftone image defect even by a small amount of paper dust. In addition, in this Embodiment 1, the replacement performance is high enough to suppress the halftone image defect, despite the fact that collection property is high and that influence of the returning toner is significant.

In comparison example 3, the non-contact development is used, and therefore, the collection property is poor, and the influence of the returning toner is relatively small. However, the influence of the foreign matter and the returning toner and the production of the toner agglomeration and the paper dust lead to a slight defect in the halftone image. The reason is that since the rigid member sleeve is used, the mirror force is high between the toner and the surface of the sleeve, and therefore, the toner and/or foreign matter are easily deposited on the sleeve, and the replacement performance is poor. For this reason, the even a small amount of the returning toner leads to the insignificant defect in the halftone image.

From the foregoing, in the contact developing system, the returning toner collection property is high, and the influence of the returning toner and the paper dust included therein is high, and therefore, very high replacement performance is required. In the contact developing system employed by this embodiment, the in-between position regulation reduces the magnetic force confining force in the regulating portion, and the provision of the elastic layer reduces the electrical depositing force, and in addition, the magnetic field in the supply portion pulls back the low specific charge toner. Therefore, high replacement performance is accomplished. As a result, satisfactory halftone images can be formed despite a relatively large amount of returning toner, generation of the agglomeration of toner and introduction of paper dust. (Relation between regulation position and magnetic pole, and range of an amount of toner coating)

The description will be made as to a relation between magnetic poles and a contact position between the regulating blade and the elastic sleeve (FIG. 3, (b), range of 45-90°), and a developer amount per unit area in a toner layer regulated by the blade prior to the development. Here, the case of FIG. 3, (b) (45-90°) will be described. However, in the cases of 0-45°and 90-135°, $|Br|/|B|$ value is relied, and the effects of this embodiment are provided. In the case of using a magnet roller having a different magnetic pole positioning, |Br|/|B| value is relied, and the effects of this embodiment are provided.

Developing Device of Embodiments 2, 3, 4, 5, 6, 7, 8:

The developing devices of these embodiments are basically the same as the developing device 60A of Embodiment 1, but are different in the following respects: Regulating blades are set such that drawing pressures are 50, 55, 55, 50, 50, 55, 60 N/m in Embodiments 2-8, respectively. The free lengths of the blades are 2.0, 1.5, 1.0, 2.5, 1.5, 2.0, 2.0 mm in Embodiments 2-8, respectively.

Referring to FIG. 3, (b), the contact positions Θ of the regulating blades are 38, 42, 54, 46, 48, 49, 54° in Embodiment 2-8, respectively. The values of |Br|/|B| are 0.03, 0.10, 0.50, 0.25, 0.30, 0.35, 0.50, in Embodiments 2-8, respectively.

In the developing devices of Embodiments 2-8, no developer feeding member for supplying the toner onto the developing sleeve is provided. Therefore, the member to which the developing sleeve first contacts after contact to the photosensitive drum is the regulating blade.

Developing Devices of Comparison Examples 10, 11, 12, 13, 14, 15, 16, 17, 18:

The developing devices of these examples are basically the same as the developing device 60A of Embodiment 1, but are different in the following respects:

The regulating blades are set such that drawing pressures are 50, 70, 75, 60, 50, 55, 60, 65, 80 N/m, in comparison examples 10-18. The free lengths of the blades are 0.5, 1.0, 1.0, 2.0, 2.5, 2.5, 1.0, 1.5, 1.5 mm, in comparison examples 10-18, respectively.

Referring to FIG. 3, the contact positions of the regulating blades are 48, 58, 62, 50, 42, 52, 58, 55, 71°, in comparison examples 10-18, respectively. In this citation, the values of |Br|/|B| are 0.30, 0.60, 0.70, 0.40, 0.10, 0.45, 0.60, 0.55, 0.90 in comparison example 10-18, respectively.

EVALUATION METHOD FOR THE EMBODIMENTS AND COMPARISON EXAMPLES

In the image forming apparatuses of scheme 1, a) fog prevention evaluation, c) ghost image prevention evaluation, d) hair line uniformity, f) solid white image defect and i) solid black density, are taken into account.

Table 2 shows the results.

TABLE 2

| | | | Scheme 1 | | | | |
|---|---|---|---|---|---|---|---|
| | *A | *B | *C | *D | *E | *F | *G |
| Emb. 2 | 0.03 | 8 | G—G | G | G | G | G |
| Emb. 3 | 0.10 | 5 | G—G | G | G | G | G |
| Emb. 4 | 0.50 | 5 | G-F | F | G | G | G |
| Emb. 5 | 0.25 | 16 | G—G | G | G | G | G |
| Emb. 6 | 0.30 | 13 | G—G | G | G | G | G |
| Emb. 7 | 0.35 | 16 | G-F | F | G | G | G |
| Emb. 8 | 0.50 | 13 | G-F | F | G | G | G |
| Comp. Ex. 10 | 0.30 | 4 | G—G | G | G | G | N |
| Comp. Ex. 11 | 0.60 | 7 | G-N | F | G | N | G |
| Comp. Ex. 12 | 0.70 | 6 | G-N | F | G | N | N |
| Comp. Ex. 13 | 0.40 | 4 | G-F | F | G | G | N |
| Comp. Ex. 14 | 0.10 | 19 | G—G | N | F | N | G |
| Comp. Ex. 15 | 0.45 | 18 | G-F | N | F | N | G |
| Comp. Ex. 16 | 0.60 | 13 | G-N | F | G | N | G |
| Comp. Ex. 17 | 0.55 | 14 | G-N | N | F | N | G |
| Comp. Ex. 18 | 0.90 | 15 | G-N | N | F | N | G |

G: Good:
F: Fair:
N: No good:
*A: |Br|/|B|
*B: M/S (g/m$^2$)
*C: a) Fog prevention 100th-3000th
*D: c) Ghost prevention
*E: d) Hair line uniformity
*F: f) Solid white defect prevention
*G: h) Solid black defect prevention The advantages of these embodiments will be described with respect to the relation between the magnetic pole and the contact position between the elastic sleeve and the regulating blade and with respect to the range of the toner coating amount. The description will be made as to the comparison between the Embodiments 2-8 and comparison examples 10-18.

Figure 14:
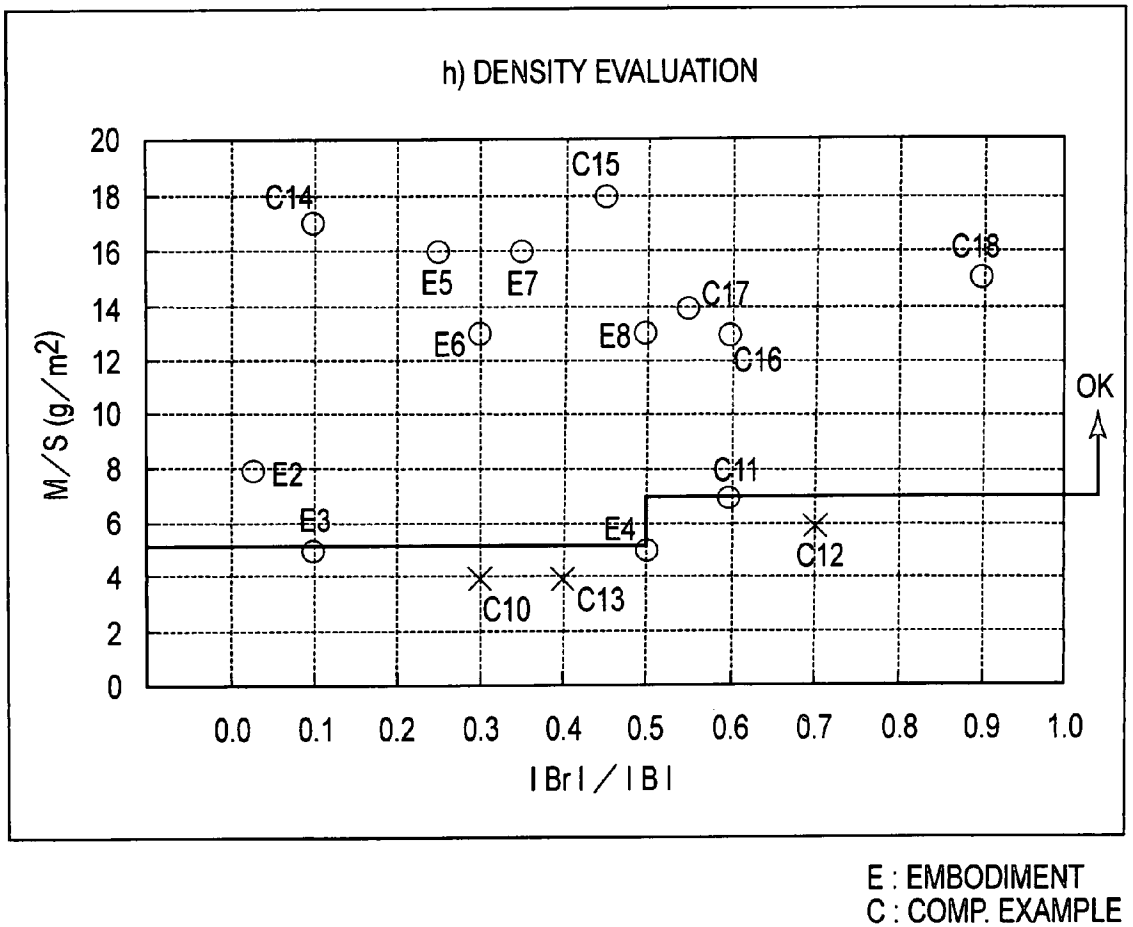
FIG. 14 is a graph of results of solid black density evaluation.

(2-1) Solid Black Density Evaluation:

h) FIG. 14 shows the results of evaluation with respect to the solid black density. In the range of |Br|/|B|≦0.5, it is understood from Embodiments 3, 4 that coating amount is desirably not less than 5. In the comparison examples 10, 13, wherein the coating amount is 4, the density of the solid black image is low.

On the other hand, in the range of |Br|/|B|>0.5, it is understood from comparison example 11, the coating amount is desirably not less than 7. In comparison example 12 which does not show the reduction of the solid black density in the range of |Br|/|B|≦0.5, the solid black density reduces when the coating amount is 6. The reason will be as follows. In the range of |Br|/|B|≦0.5 wherein the horizontal magnetic field is dominant, the toner replacement performance is good, and in addition, the contact pressure in the blade regulation can be low, and therefore, the toner is not easily deteriorated. Therefore, the uniform distribution of the specific charge in the toner layer can be maintained in a long term, and therefore, the reduction of the development efficiency can be suppressed. On the other hand, in the range of |Br|/|B|>0.5 wherein the perpendicular magnetic field is dominant, the toner replacement performance is poor, and in addition, the contact pressure in the regulating blade has to be high, and therefore, the toner tends to easily deteriorate. For this reason, the uniform distribution of the specific charge in the toner layer is not maintained in a long term, so that development efficiency lowers with time. When the development efficiency reduces, it is necessary to set the coating amount at a relatively high level. For this reason, in the range of |Br|/|B|>0.5, the minimum necessary coating amount is 7.

From the foregoing analysis, in the range of |Br|/|B|≦0.5 and in the range of not less than 5 of the coating amount, the solid black density can be stably maintained.

Figure 15:
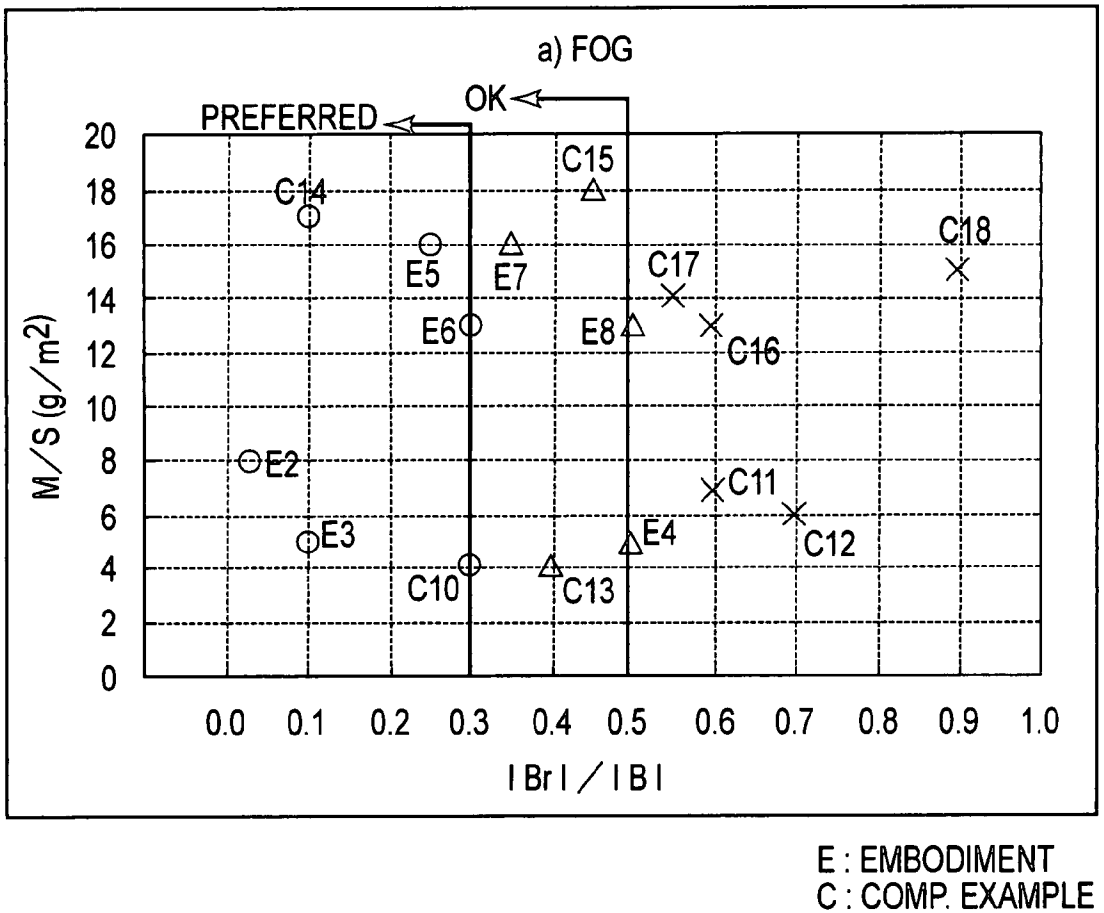
FIG. 15 is a graph of results of fog prevention evaluation.

(2-2) Fog Prevention Evaluation in Long Term use:

The description will be made as to the image evaluation with respect to the fog prevention after 3000 prints. FIG. 15 show the results of image evaluation with respect to the fog prevention after 3000 prints. In comparison examples 11, 12, 16, 17, 18, wherein |Br|/|B|>0.5, the fog becomes worse with use. On the other hand, in Embodiments 4, 8, wherein

|Br|/|B|≦0.5, the increase of the fog amount is suppressed. The reason is as follows. Similarly to the case of solid black image density, in the range of |Br|/|B|≦0.5, the low load property against the toner and the high replacement performance suppress the production of low specific charge toner and the production of opposite polarity toner, and therefore, is effective to suppress the fog production. By using the range of |Br|/|B|≦0.3, as in Embodiment 6 and comparison example 10, the change, with use, of the fog amount is suppressed. By selecting the range in which the horizontal magnetic field is dominant, the load against the toner is reduced, and the toner replacement performance is enhanced, thus suppressing the image defect due to the foggy background.

From the foregoing analysis, from the standpoint of image defect due to the fog, the regulating blade is contacted to the elastic sleeve in the range satisfying |Br|/|B|≦0.5 which means the horizontal magnetic field is dominant according the embodiments of the present invention. The positioning satisfying |Br|/|B|≦0.3 is further preferable.

Figure 16:
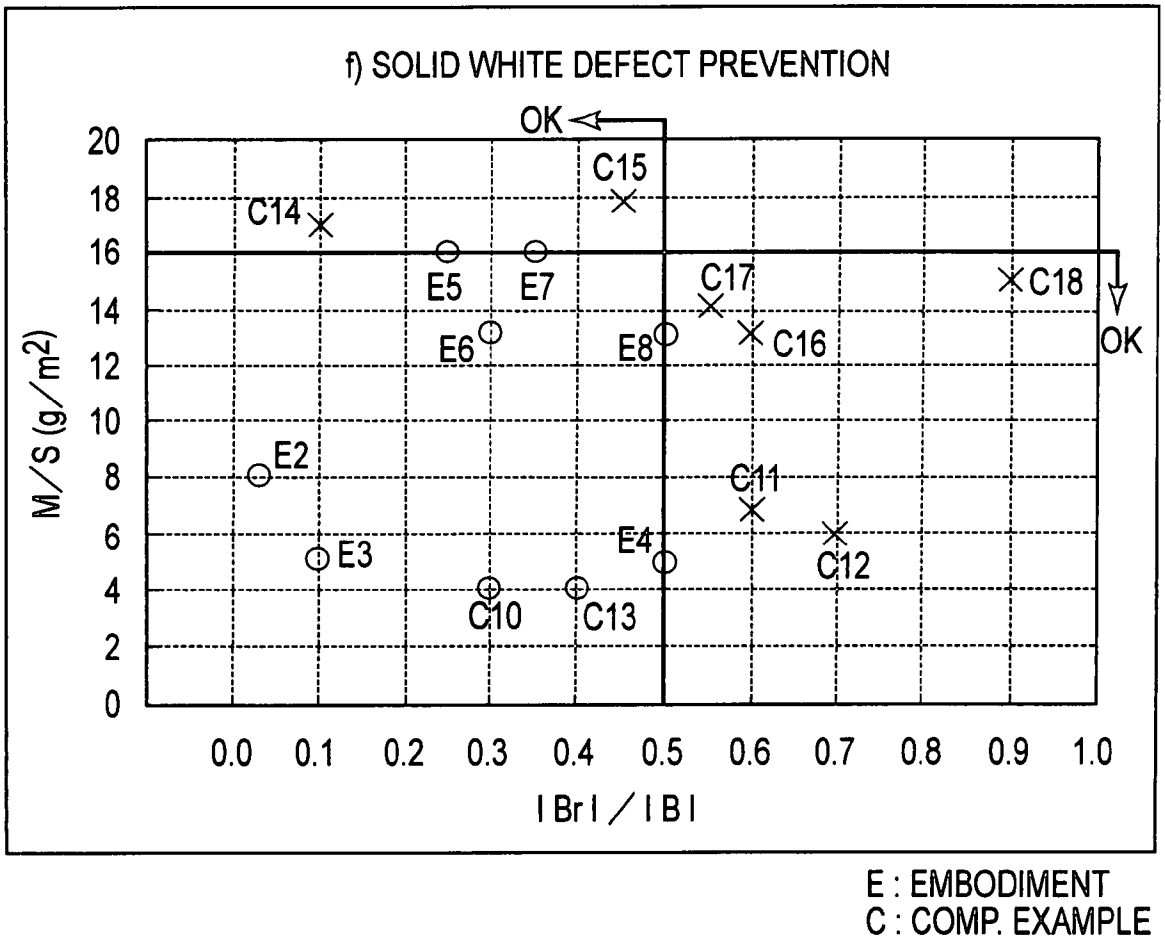
FIG. 16 is a graph of solid white image defect.

(2-3) Solid White Image Evaluation:

The solid white image defect will be described. FIG. 16 shows the results of image evaluation in this respect. As will be understood from FIG. 16, the solid white image defect appears in the range of |Br|/|B|>0.5. On the other hand, in the range of |Br|/|B|≦0.5 as in Embodiments 4, 8, the solid white image defect is suppressed. The reason would be that arrangement with which the horizontal magnetic field is dominant, the toner replacement performance is enhanced to permit sufficient replacement or exchange between the upper part and the lower part of the toner layer. Therefore, from the standpoint of suppression of the solid white image defect, the contact position of the regulating blade preferably satisfies |Br|/|B|≦0.5.

In comparison example 14 and comparison example 15, the solid white image defect appears despite the contact position of the regulating blade satisfying |Br|/|B|≦0.5. Therefore, setting the contact position of the regulating blade to satisfy |Br|/|B|≦0.5 alone is not enough to suppress the solid white image defect. In Embodiment 5, 7, wherein the coating amount is 16, the solid white image defect is suppressed. As will be understood from this, if the toner coating layer exceeds 16, no sufficient toner replacement performance is provided, with the result of production of the solid white image defect. By setting the coating layer not more than 16, the toner replacement performance is enough.

From the foregoing, from the standpoint of suppression of the solid white image defect, the regulating blade contact position desirably satisfy |Br|/|B|≦0.5, and also, the toner coating amount is desirably not more than 16 g/m$^2$.

Figure 17:
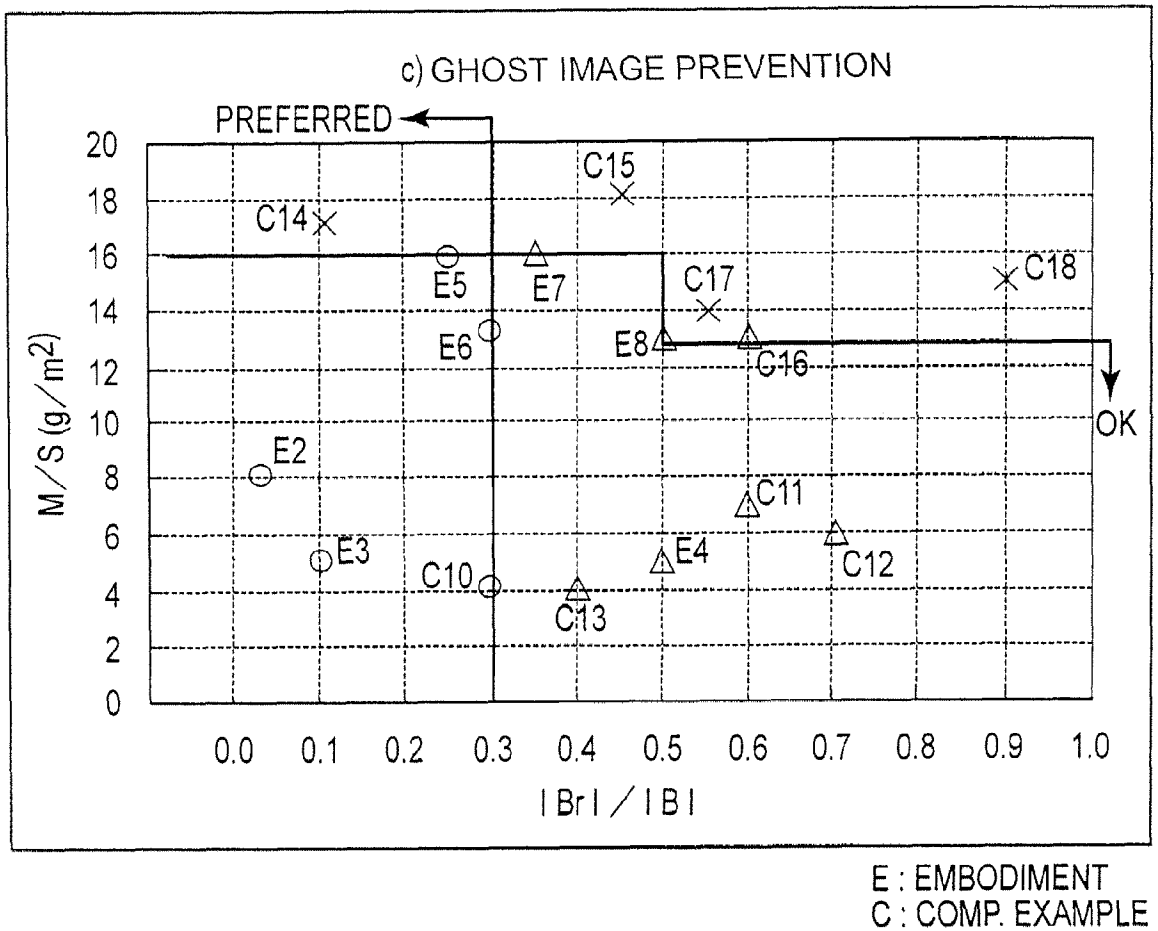
FIG. 17 is a graph of ghost image defect.

(2-4) Ghost Image Prevention Evaluation:

The ghost image prevention evaluation will be described. FIG. 17 shows results of the ghost image prevention evaluation.

The case of the contact position of the regulating blade satisfying |Br|/|B|>0.5 will first be described. In the |Br|/|B|>0.5, no examples are satisfactory. In comparison examples 17, 18, the ghost image defect appears when the coating amount is 14 or 15. When the coating amount is reduced to 13 as in comparison example 16, the ghost image defect becomes slight. Even when the coating amount is reduced to 7 or 6, as in comparison example 11 or comparison example 12, the ghost image defect does not disappear. Thus, in the range of |Br|/|B|>0.5, the toner replacement is poor, so that ghost image prevention is not improved even by limiting the coating layer.

When the coating amount is 16, and the contact position of the regulating blade satisfies the |Br|/|B|>0.5, the ghost image defect prevention is not good, but in the range of |Br|/|B|≦0.5, that is, the horizontal magnetic field is dominant, the upper limit value of the coating amount is larger. Since the horizontal magnetic field is dominant, the toner replacement performance is so improved that even if the coating amount increases, the toner replacement is possible. Furthermore, the ghost image defect is avoided with the contact position of the regulating blade satisfying |Br|/|B|=0.3 as in Embodiment 6 and comparison example 10. As described in the foregoing, from the standpoint of ghost image prevention, the coating amount is preferably not more than 13 within the range of |Br|/|B|>0.5 (the normal or perpendicular magnetic field is dominant), and is preferably not more than 13 within the range of |Br|/|B|≦0.5 (the horizontal magnetic field is dominant). The ghost image is remarkably improved by setting the coating amount not more than 16 and setting the regulating position so as to satisfy |Br|/|B|≦0.3 (the horizontal magnetic field is dominant).

In comparison examples 14, 15, 17, 18, wherein the ghost image defect prevention evaluation is no good, the hair line uniform is slightly unsatisfactory. In addition to the reduction of the toner replacement performance in the coating layer, the reduction of the uniform specific charging property, causes a trailing in the developing zone, which deteriorates the hair line uniformity.

Figure 18:
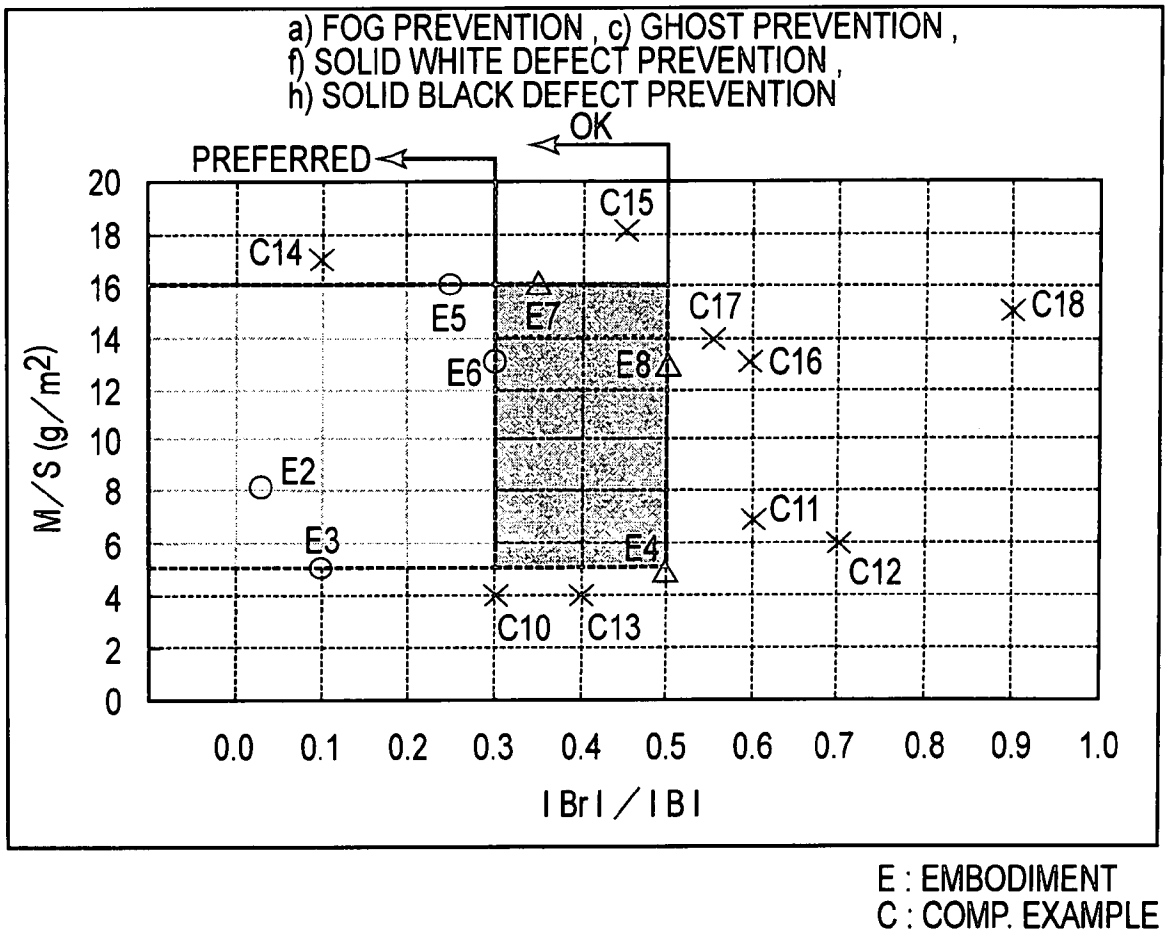
FIG. 18 is a graph of results of overall evaluation.

(2-5) Overall Evaluation:

As will be understood from Embodiments 2-8 and comparison examples 10-18, the contact position of the regulating blade preferably satisfies |Br|/|B|≦0.5, and further preferably satisfies |Br|/|B|≦0.3, as shown in FIG. 18. In the case of stable, all the image evaluations are stably good.

In the range of |Br|/|B|>0.5, the regulation pressure of the regulating blade is too high that specific charge application property is weak with the result of easy deterioration of the toner and increase of the fog amount with use. The poor toner replacement performance results in solid white image defect.

The coating amount of the toner is preferably 5-16 g/m$^2$. If the toner coating amount is less than 5, the solid black density is low, and if the toner coating amount exceeds 16, the toner layer is too thickness, and therefore, the non-uniformity of the specific charge of the entire toner layer and the non-uniformity of the toner layer tends to occur, and in addition, the toner replacement performance deteriorates. Thus, image defect in the solid white image results, and in addition, the ghost image is produced due to the insufficient removal and apply of the toner occurs on the elastic sleeve. Furthermore, the magnetic chain becomes longer with the result of deterioration of the hair line uniformity.

Figure 19:
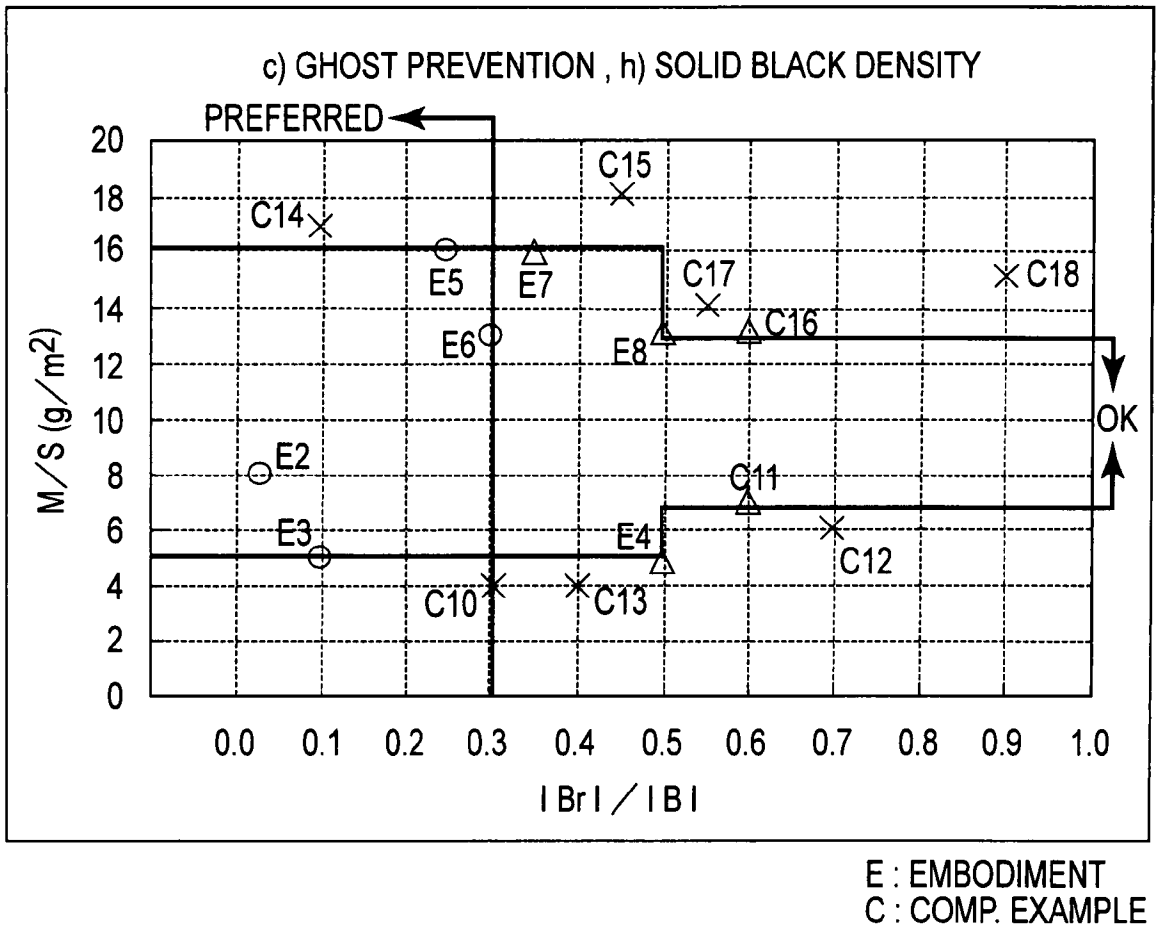
FIG. 19 is a graph of results of ghost image prevention evaluation.

(2-6) Ghost Image and Solid Black Image Density:

The evaluations with respect to the ghost image and the solid black image density will be described. FIG. 19 shows the results of these image evaluations. In the region in which the ghost image rank is good or fair and in which the solid black density evaluation is good, the toner coating amount is 7-13 in the range of |Br|/|B|>0.5, and is 5-16 in the range of |Br|/|B|≦0.5. It is understood that in the range of |Br|/|B|≦0.5, the margin against the variation in the toner coating amount expands. In other words, satisfactory images can be stably provided against the change, with time, of the toner coating amount and against the variation in the ambient conditions or the like.

(2-7)

As described in the foregoing, by using the magnetic force for the supply of the toner onto the developing sleeve having the elastic layer, the toner can be removed and supplied without deteriorating the toner. In addition, by contacting the elastic sleeve to the photosensitive drum, good images can be provided without the image edge defect. This is accomplished by setting the contact position between the regulating blade and the elastic sleeve at a position where the magnetic pole strength is in a proper range, and by maintaining the coating amount of the toner layer within a proper range. In addition, the good images can be stably formed against the coating amount variation and ambience variations with sufficient margins.

(3-1) A Developing Device of an Embodiment of the Present Invention wherein the Material of the Regulating Blade is Urethane Material, will be Described.

Developing Device of Embodiment 9

Contact Development, Elastic Sleeve, In-between Position Regulation, and Urethane Blade This embodiment is similar to the developing device of Embodiment 1 except that regulating blade is made of an urethane having a dielectric constant $\epsilon b=4.3$. The regulating blade of Embodiment 1 is made of phosphor bronze, and the dielectric constant is very high. Ordinarily, a metal has a dielectric constant of infinity. In Embodiment 1, the dielectric constant $\epsilon s$ of the surface of the sleeve is 6.5, and the relation with the dielectric constant $\epsilon b$ of the regulating blade is $\epsilon s<\epsilon b$. On the other hand, in Embodiment 9, the relation is $\epsilon s>\epsilon b$. The image evaluation of this case is carried out. The resultant images are good as in Embodiment 1.

In order to compare Embodiment 1 and Embodiment 9, the ghost image prevention evaluations are carried out after continuous 3000 prints in the similar manner. In Embodiment 1, the evaluation is good, but in Embodiment 9, the ghost image slightly appears although the rank is "G"

The reason will be described. At the contact position between the regulating blade and the elastic sleeve, the mirror force between the toner and the surface of the elastic sleeve is Fts, and a mirror force between the toner and the regulating blade is Ftb. The mirror force, as described above, is proportional to $P=(\epsilon-1)/(\epsilon+1)$. Therefore, in Embodiment 1, P between the toner and the elastic sleeve is 0.73, and P between the toner and the regulating blade is 1, and therefore, Fts<Ftb. For this reason, in the region upstream of the contact nip between the elastic sleeve and the regulating blade, the toner particles for which the attraction force relative to the elastic sleeve surface is not sufficient, in other words, the specific charge is not sufficient, are relatively easily attracted toward the regulating blade. With generation of such powder flow, a very high percentage of the toner particles having sufficient charge can be passed through the regulating position having the regulating blade. Using such a function, the toner particles unable to pass by the regulating blade, tends to move in the direction opposite to the sleeve rotational direction, so that toner replacement performance is improved. As a result, the ghost image defect is stably prevented in Embodiment 1.

In Embodiment 9, on the other hand, P between the toner and the elastic sleeve is 0.73, and P between the toner and the regulating blade is 0.62, and therefore, Fts>Ftb. In such a case, in the region upstream of the contact nip between the regulating blade and the elastic sleeve, even the toner particles having low specific charge are easily attracted toward the surface of the sleeve. Therefore, the toner not having a sufficient specific charge tends to pass under the regulating portion blade. The toner unable to pass under the regulating blade, does not easily move in the direction opposite to the rotational direction of the sleeve, and therefore, the toner replacement performance deteriorates. For this reason, the ghost image defect slightly appears.

From the foregoing analysis, from the standpoint of ghost image prevention and toner replacement performance, the dielectric constant $\epsilon s$ of the surface of the elastic sleeve and the dielectric constant $\epsilon b$ of the blade preferably satisfy $\epsilon s<\epsilon b$.

(3-2) A Developing Device of an Embodiment wherein the Developing Bias Voltage Contains an AC Voltage Component:

Developing Device of Embodiment 10

Embodiment 1 but with AC Bias Voltage Application

The developing apparatus of this Embodiment is different from the developing device 60A of the Embodiment 1 in the developing bias applying voltage source S2. The developing bias applying voltage source S2 of this embodiment applies the developing bias voltage of DC voltage −450V superimposed with an AC voltage in the form of a rectangular wave having a frequency of 1.2 kHz and a peak-to-peak voltage of 300V.

In Embodiment 10, the AC bias is superimposed as contrasted to Embodiment 1. By the application of the AC voltage, the fog prevention effect is better than in Embodiment 1. The fog deposition on the drum after the development is clearly improved, and therefore, a certain degree of AC bias application reduces the fog. When the AC component is contained, even the developing sleeve involving a defect such as deposition of the foreign matter is no problem since the defective portion does not appear on the image, and therefore, a wider margin is provided for the reproduction of the half-tone images. In addition, in scheme 2 type, the collection rate is higher when the AC voltage component is applied than when it is not applied.

The investigation has been made as to the change of the fog amount with respect to the maximum absolute value |V| max of the developing bias and the dark potential absolute value |Vd|. As a result, the fog amount on the photosensitive drum remarkably increases if the maximum absolute value of the developing bias exceeds the dark potential absolute value. On the other hand, if the |V| max does not exceed |Vd|, it is considered that developing bias is always larger than Vd, and therefore, the toner does not transfer to the non-printing area. From this $|V|max\leqq|Vd|$ is effective to remarkably suppress the fog amount.

If |V| max is larger than |Vd|, the Vpp of the AC voltage applied as the developing bias is so high that toner particles reciprocating in the developing zone is concentrated at the edge of the image on the photosensitive drum, with the result of image edge defect. If $|V|max\leqq|Vd|$, the reciprocating motion of the toner particles in the developing zone is suppressed, so the image edge defect is reduced.

In a cleaner-less system, the paper dust may reach the development position as shown in FIG. 13. Even if this occurs, the leakage does not easily occur if $|V|max\leqq|Vd|$. Even if the leakage occurs, the light portion potential Vl does not exceed the dark portion potential Vd, so that image defect by while spots in the solid black image can be avoided.

In addition, it has been found that as compared with the case in which the developing roller is press-contacted to the photosensitive drum, the uniformity of the thin horizontal and vertical lines is deteriorated if only the toner layer on the developing roller is lightly contacted to the photosensitive drum. The reason will be considered. When only the toner layer is contacted, the chain of the toner particles erects in the developing zone. The toner is transferred onto the drum under the existence of the erected toner chains, tailing occurs, and therefore, the uniformity of the width of the lateral and longitudinal lines worsens. Therefore, by the contact development in which the developing roller is contacted to the photosensitive drum, the trailing of the toner is suppressed, and the uniformity of the thin lines is improved.

As described in the foregoing, the developing devices of these embodiments provide balanced and improved properties in the fog prevention, the prevention of fog immediately before the toner shortage, the image density, the ghost image prevention, the hair line uniformity, the image edge defect prevention, the solid white image defect, the tone gradation reduction prevention and halftone image defect prevention. Particularly, with respect to the tone gradation, the solid white image defect prevention and the hair line uniformity, the improvement is accomplished by the proper relation between the magnetic pole and the contact position between the developing sleeve and the toner regulating blade and by the proper level of the coating amount in the toner coating layer.

Furthermore, the developing device of the present invention is particularly effective for an image recording device of a toner recycling system type, in that collection property in the cleanerless system, and the halftone image defect prevention, the prevention of halftone image defect due to the paper dust, and the solid black image defect prevention are improved. Particularly, in the cleaner-less system, if a solid white image defect appears, the transfer roller is contaminated even to such an extend that charging is impossible due to the contamination of the charging roller with the result of whole surface black image is produced. If this occurs, the transfer material may be wrapped around a fixing device, and an apparatus failure may result. The solid white image defect can be remarkably suppressed by the present invention.

Additionally, the above-described advantageous effects can be stably provided even under the change with time, the ambient condition variation, the variation in the toner coating amount and the like.

Other Embodiments 1) the image recording device has been described as a laser beam printer as an example, but this is not limiting, and the present invention is applicable to other image forming apparatuses such as an electrophotographic copying machine, a facsimile machine, a word processor and the like.

2) the image bearing member (a member to be developed) is a dielectric member for electrostatic recording, in the case of an electrostatic recording apparatus.

3) the developing device of the present invention is not limitedly for an image bearing member of an image recording device (an electrophotographic photosensitive member, a dielectric member for electrostatic recording or the like), but is usable with other members to be developed, developing process means (including particle collector).

In the embodiments of the present invention, the AC voltage used as the developing bias, may be a rectangular wave formed by repeating ON/OFF of a DC voltage source. In other words, the AC voltage may be formed by a DC voltage source not by the AC voltage source.

The description will be made as to the advantage effects of the present invention.

(Effect 1) Table 1, a) Fog Prevention Evaluation:

The surface of the developer carrying member is an elastic member; the developer is one component magnetic toner; the developer is attracted onto the developer carrying member by magnetic field generating means provided in the developer carrying member; the contact position between the developer carrying member and the developer amount regulating member satisfy $|Br|/|B| \leqq 0.5$. By doing so, the developer is magnetically fed on the surface of the developer carrying member, and therefore, there is no need of using a developer supplying roller, and the stress applied to the developer can be reduced. Since the toner is regulation by the regulating member in the region where the horizontal magnetic field is dominant, the urging force from the regulating member to the developer carrying member may be small, and therefore, the stress applied to the developer is reduced. Because of this, even after a large number of prints are produced particularly with low print ratio, the deterioration of the developer is remarkably suppressed, and therefore, the increase of the fog amount due to the deterioration of the developer can be suppressed.

(Effect 2) Table 1, a) Fog Prevention Evaluation:

The surface of the developer carrying member is not a metal but an elastic layer, and therefore, the dielectric constant of the surface of the developer is low. Therefore, even if the developer is deteriorated due to the enhancement of the developer replacement performance and enhancement of the charging property, the high charging property is enough to suppress increase of the fog amount due to the deterioration of the developer.

(Effect 3) Table 1, b) Fog (Upon Toner Shortage) Prevention Evaluation:

The surface of the developer carrying member is elastic member; the developer is one component magnetic toner; the developer is magnetically fed. Therefore, there is no need of providing a developer supplying roller for supplying the developer onto the developer carrying member, so that deterioration of the developer can be remarkably prevented. When the amount of the remaining toner is very small in the developing device, the increase of the fog amount by mixture of the deteriorated developer and the less deteriorated developer can be suppressed.

(Effect 4) Table 1, c) Ghost Image Prevention Evaluation:

The surface of the developer carrying member is elastic member; the developer is one component magnetic toner; the developer is magnetically fed; the amount of the developer on the developer carrying member is 5-16 $g/m^2$; the contact position between the developer carrying member and the developer amount regulating member satisfy $|Br|/|B| \leqq 0.5$. Therefore, the developer is regulated by the regulating member in the region where the horizontal magnetic field is dominant. Such regulation and the provision of the elastic layer having a dielectric constant lower than that of metal improve the toner replacement or exchange property, and the charging property, thus suppressing the ghost image defect.

(Effect 5) By the Combination of (Effect 4) and (Effect 1), the Fog Prevention and Ghost Image Defect Prevention are Both Accomplished.

(Effect 6) Table 1:

The contact developing system is used; the surface of the developer carrying member is an elastic member; the developer is one component magnetic toner; the developer is magnetically fed; the developer amount regulated by the regulating member is 5-16 g/m$^2$; the contact position between the regulating member and the developer carrying member satisfy $|Br|/|B| \leqq 0.5$. Therefore, the developer is regulated in the region where the horizontal magnetic field is dominant. By such a regulation and the elastic layer having a dielectric constant lower than that of metal, the developer amount can be regulated to such an amount that toner replacement performance is not remarkably deteriorated. Accordingly, the toner replacement performance is improved, and the charging property is improved.

(Effect 7) Table 1, g) Halftone Image Defect Prevention Evaluation:

The surface of the developer carrying member is an elastic member; the developer is one component magnetic toner; the developer is magnetically feeding on the surface of the developer carrying member; the contact position between the regulating member and the developer carrying member satisfy $|Br|/|B| \leqq 0.5$. Therefore, there is no need of provision of a developer supplying roller, so that stress applied to the developer is reduced. Since the developer is regulated in the region where the horizontal magnetic field is dominant, the pressure between the regulating member and the developer carrying member is small, and therefore, the stress applied to the developer is reduced. The combination of such a regulation and the elastic layer, at the surface of the developer carrying member, having a dielectric constant lower than that of metal, is effective to improve the toner replacement performance. Accordingly, the toner agglomeration is suppressed; and even if a foreign matter is introduced, and toner coagulated material is produced, the occurrence of the halftone image defect can be suppressed.

(Effect 8) Table 1, h) Solid Black Density Image Evaluation:

The surface of the developer carrying member is an elastic member; the developer is one component magnetic toner; the developer is magnetically fed; the contact position between the developer carrying member and the regulating member satisfy $|Br|/|B| \leqq 0.5$. Therefore, the developer supplying roller is not necessary, and therefore, the stress applied to the developer is reduced. The combination of such a regulation and the regulation at the position where the horizontal magnetic field is dominant, is effective to reduce the pressure between the developer amount regulating member and the developer carrying member, so that stress applied to the developer is reduced. The surface of the developer carrying member is an elastic layer having a dielectric constant lower than that of the metal, and therefore, the toner replacement performance is improved. This suppresses removal, form the toner particles, of the externally added material having a size smaller than the toner particles, so that deposition of the externally added material on the surface of the sleeve can be avoided, thus preventing the reduction of the charging property of the developer due to the removed externally added material. This is effective to suppress the reduction of the solid black density.

(Effect 9) Table 1, i) Tone Gradient Image Evaluation:

The contact developing system is used; the surface of the developer carrying member is an elastic member; the developer is one component magnetic toner; the developer is magnetically fed; and the contact position between the regulating member and the developer carrying member satisfy $|Br|/|B| \leqq 0.5$. Therefore, the toner amount is regulated in the region where the horizontal magnetic field is dominant. By the combination of such regulation and the elastic layer, at the surface of the developer carrying member, having a dielectric constant lower than that of metal, the charging property is improved, and the distribution of the charge in the coating layer is uniform, so that tone gradation is improved.

(Effect 10), FIG. 19:

The contact developing system is used; the surface of the developer carrying member is an elastic member; the developer is one component magnetic toner; the developer is magnetically fed; and the contact position between the regulating member and the developer carrying member satisfy $|Br|/|B| \leqq 0.5$. Therefore, the toner amount is regulated in the region where the horizontal magnetic field is dominant. By the combination of such regulation and the elastic layer, at the surface of the developer carrying member, having a dielectric constant lower than that of metal, the charging property is improved, and the distribution of the charge in the coating layer is uniform. This improves the solid black density and the ghost image prevention against the ambient condition change, and against the variation in the coating amount of the toner layer with long term use, so that margin is broadened.

(Effect 11), FIG. 18:

By satisfying $|Br|/|B| \leqq 0.3$, the effect 1-10 is further enhanced.

(Effect 12), Embodiment 9:

The feature of $\epsilon s \leqq \epsilon b$ is effective to improve the toner replacement performance at the position upstream of the contact position between the surface of the developer carrying member and the regulating member, so that charging property is improved, and the ghost image defect can be suppressed.

(Effect 13), Table 1, d) Hair Line Uniformity Evaluation:

The developing bias of DC voltage is applied; the contact development is used. Therefore, the trailing of the toner can be suppressed, and the uniformity of the thin lines is improved.

(Effect 14), Table 1, e) Image Edge Defect Prevention Evaluation:

The developing bias of a DC voltage is applied; the contact development is used. This is effective to suppress the image edge defect with which the downstream side of the image with respect to the process advancement has a high density in the developed image, and an edge of a half-tone portion adjacent to the high density portion has a low density.

(Effect 15), Embodiment 10:

The developing bias of a DC voltage plus AC voltage is applied; $|V|max \leqq |Vd|$ is satisfied; the contact development is used. The trailing of the toner is suppressed, so that uniformity of the thin line is improved.

(Effect 16), Embodiment 10:

The developing bias of a DC voltage plus AC voltage is applied; $|V|max \leqq |Vd|$ is satisfied; the contact development is used. This is effective to suppress the image edge defect with which the downstream side of the image with respect to the process advancement has a high density in the developed image, and an edge of a half-tone portion adjacent to the high density portion has a low density.

(Effect 17), Table 1, A) Collection Property in Cleanerless System:

The cleaner-less system is used; and the contact development is used. Therefore, the developer carrying member is closer to the image bearing member, and therefore, the region in which the electric field or the magnetic field work increases and the intensities of the electric field and the magnetic field increases, so that collection property of the residual developer deposited on the un-exposed portion of the upper.

(Effect 18), Table 1, B) Halftone Image Defect Prevention (Scheme 2):

The cleaner-less system is used; the developer is one component magnetic toner; and the developer is magnetically fed. Therefore, the developer supplying roller is not necessary, and therefore, the deterioration of the toner by the development remaining toner can be suppressed. The contact position between the regulating member and the developer carrying member satisfy $|Br|/|B| \leqq 0.5$, so that amount of the toner is regulation in a region where the horizontal magnetic field is dominant. With the combination of this feature and the provision of the elastic layer having a dielectric constant smaller than that of metal, the toner replacement performance is improved. Therefore, the production of toner agglomeration around a foreign matter included in the development remaining toner can be suppressed, and the halftone image defect attributable to the deposition of the toner agglomeration onto the developer supplying roller can be suppressed.

(Effect), Table 1, C) Evaluation of Prevention of Halftone Image Defect Due to Paper Dust:

The cleaner-less system is used; the developer is one component magnetic toner; and the developer is magnetically feeding. Therefore, the developer supplying roller is not necessary. Accordingly, even when the number of the printing operation increases, there is no sliding between the developer supplying roller and the developer carrying member, and no paper dust included in the development remaining toner does not stagnates on the developer supplying roller. This is effective to suppress the halftone image defect which appears periodically (corresponding to the circumferential length of the developer carrying member) due to insufficient toner removal and supply.

(Effect 20), Table 1, D) Evaluation of Solid Black Image Defect Prevention:

The cleaner-less system is used; the developing bias of a DC voltage is applied; the contact development is used. This is effective to suppress leakage which may occur through the paper dust included in the residual toner under the high temperature and high humidity condition, and the image defect of white spots in the solid black image can be suppressed.

(Effect 21), Embodiment 10:

The cleaner-less system is used; the developing bias of a DC voltage plus AC voltage is used; $|V|max \leqq |Vd|$ is satisfied; and the contact development is used. This is effective to suppress leakage which may occur through the paper dust included in the residual toner under the high temperature and high humidity condition, and the image defect of white spots in the solid black image can be suppressed.

While the invention has been described with reference to the structures disclosed herein, it is not confined to the details set forth and this application is intended to cover such modifications or changes as may come within the purpose of the improvements or the scope of the following claims.

This application claims priority form Japanese Patent Application No. 095870/2004, filed Mar. 29, 2004, which is herby incorporated by reference.

What is claimed is:

1. A developing apparatus comprising:

a developer carrying member for carrying a developer including one component magnetic toner to develop an electrostatic image formed on an image bearing member with the developer, said developer carrying member including an elastic member contactable to the image bearing member;

magnetic field generating means, disposed in said developer carrying member, for generating a magnetic field for attracting the developer to said developer carrying member; and a regulating member for regulating an amount of the developer carried on said developer carrying member;

wherein said developer carrying member is disposed such that said elastic member presses the developer carried on said developer carrying member to said image bearing member; and wherein an amount, per unit area, of the developer regulated by said regulating member and applied on said developer carrying member is 5-16 $g/m^2$, and at a position where said regulating member is contacted to said developer carrying member, a magnetic flux density B generated by said magnetic field generating means, and a component Br of the magnetic flux density B normal to a surface of said developer carrying member, satisfy, $|Br|/|B| \leqq 0.5$.

2. An apparatus according to claim 1, wherein $|Br|/|B| \leqq 0.3$ is satisfied.

3. An apparatus according to claim 1, wherein a dielectric constant $\epsilon s$ of said elastic member and a dielectric constant $\epsilon b$ of said regulating member satisfy, $\epsilon s \leqq \epsilon b$.

4. An apparatus according to claim 1, wherein said developer carrying member is supplied with a DC voltage not containing an AC voltage component.

5. An apparatus according to claim 1, wherein said developer carrying member is supplied with a superimposed voltage comprising an AC voltage component and a DC voltage component, wherein a maximum value $|V|$ max of an absolute value of the superimposed voltage and a charged potential Vd of a surface of said image bearing member, satisfies $|V|$ max $\leqq |Vd|$.

6. An apparatus according to claim 1, wherein said developing device is contained in a cartridge detachably mountable to a main assembly of an image forming apparatus.

7. An apparatus according to claim 1, wherein said developing device is contained, together with said image bearing member, in a cartridge detachably mountable to a main assembly of an image forming apparatus.

8. An apparatus according to any one of claims 1-7, wherein said developing apparatus is capable of carrying out a developing operation and simultaneously collecting a residual developer from said image bearing member.

9. An apparatus according to any one of claims 1-7, wherein a member, to which said developer carrying member contacts after contacting said image bearing member, is said regulating member.

* * * * *

UNITED STATES PATENT AND TRADEMARK OFFICE

CERTIFICATE OF CORRECTION

PATENT NO. : 7,251,441 B2
APPLICATION NO. : 11/091823
DATED : July 31, 2007
INVENTOR(S) : Kazunari Hagiwara et al.

It is certified that error appears in the above-identified patent and that said Letters Patent is hereby corrected as shown below:

COLUMN 5:
Line 53, “the” should be deleted.

COLUMN 6:
Line 67, “re circulated” should read --re-circulated--.

COLUMN 7:
Line 21, “contaminantive” should read --contaminative--.

COLUMN 8:
Line 31, “Sβand” should read --Sβ and--.

COLUMN 10:
Line 18, “regulation” should read --regulation.--.

COLUMN 14:
Line 37, “increase” should read --increase in--.

COLUMN 15:
Line 7, “describe” should read --described--.
Line 31, “a” should be deleted.
Line 36, “with increase the number” should read --with an increase in the number--.

COLUMN 17:
Line 24, “there between” should read --therebetween--.
Line 58, “lowers” should read --is lower--.

COLUMN 22:
Line 38, “the” (second occurrence) should be deleted.
Line 47, “In” should read --in-- and “In addition,” should be deleted.

COLUMN 33:
Line 30, “suppression” should read --suppressing of--.

COLUMN 34:
Line 41, “the” (first occurrence) should be deleted.
Line 58, “dust. (Relation” should read --dust. ¶(Relation--.

UNITED STATES PATENT AND TRADEMARK OFFICE

CERTIFICATE OF CORRECTION

PATENT NO. : 7,251,441 B2
APPLICATION NO. : 11/091823
DATED : July 31, 2007
INVENTOR(S) : Kazunari Hagiwara et al.

It is certified that error appears in the above-identified patent and that said Letters Patent is hereby corrected as shown below:

COLUMN 38:
Line 35, “thickness” should read --thick,--.

COLUMN 41:
Line 2, “defect by while spots” should read --defects caused by white spots--.
Line 40, “extend” should read --extent--.
Line 53, “the” should read --The--.
Line 59, “the” should read --The--.
Line 62, “the” should read --The--.

COLUMN 43:
Line 57, “form” should read --from--.

COLUMN 45:
Line 42, “stagnates” should read --stagnate--.

COLUMN 46:
Line 4, “form” should read --from--.

Signed and Sealed this

Fifteenth Day of April, 2008

JON W. DUDAS
*Director of the United States Patent and Trademark Office*